United States Patent [19]

DiMatteo

[11] Patent Number: 4,776,047

[45] Date of Patent: Oct. 11, 1988

[54] MULTIPLE FUNCTION INVALID BED ARRANGEMENT

[75] Inventor: Paul DiMatteo, Huntington, N.Y.

[73] Assignee: Med Bed Technologies, Inc., Hauppauge, N.Y.

[21] Appl. No.: 731,533

[22] Filed: May 7, 1985

[51] Int. Cl.[4] ..... A61G 7/08

[52] U.S. Cl. ..... 5/81 R; 5/81 B; 5/81 C; 5/88

[58] Field of Search ..... 5/61, 81 R, 81 B, 81 C, 5/86, 88

[56] References Cited

U.S. PATENT DOCUMENTS

| | | | |
|---|---|---|---|
| 378,220 | 2/1888 | Staples et al. | 5/81 B |
| 716,886 | 12/1902 | Goode | 5/81 B |
| 2,536,707 | 1/1951 | Allyn | 5/81 B |
| 3,593,351 | 8/1969 | Dove | 5/81 R |
| 3,794,313 | 2/1974 | Berger et al. | 5/81 C |
| 3,810,263 | 5/1974 | Taylor et al. | 5/81 R |
| 4,011,609 | 3/1977 | Bethlen | 5/81 B |
| 4,222,132 | 9/1980 | Crim et al. | 5/81 C |

FOREIGN PATENT DOCUMENTS

| | | | |
|---|---|---|---|
| 2100122 | of 1902 | United Kingdom | 5/61 |

*Primary Examiner*—Alexander Grosz
*Assistant Examiner*—Michael F. Trettel
*Attorney, Agent, or Firm*—Max Fogiel

[57] ABSTRACT

An arrangement for transferring a prone patient longitudinally or laterally between beds or surfaces adapted to accept the patient in prone position. The rate of transfer of the patient can be made variable or fixed. The arrangement is adapted to function with a conventional bed normally used in a home, or with a hospital-type bed. During times when the patient is not being transferred, the arrangement may allow the mattress to be raised under the patient's head and back or under the patient's knees and legs.

15 Claims, 25 Drawing Sheets

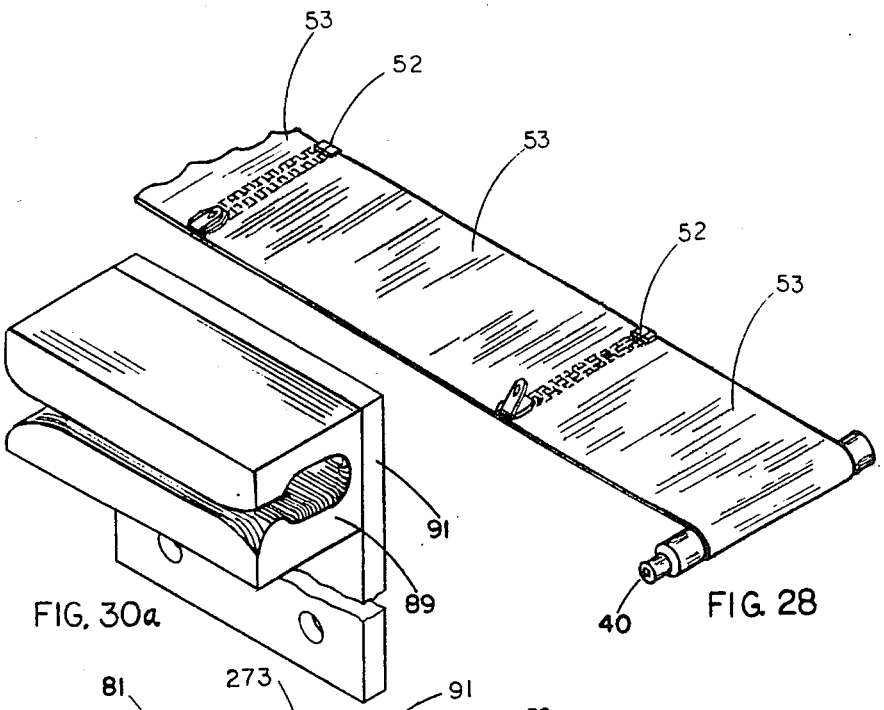
FIG. 30a
FIG. 28
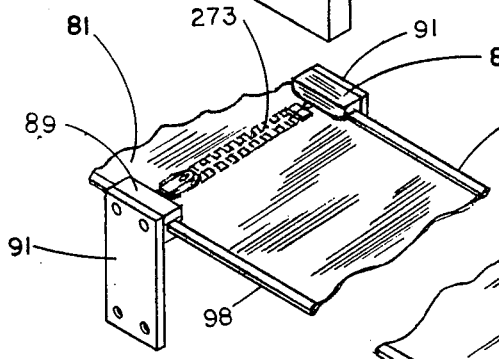
FIG. 30c
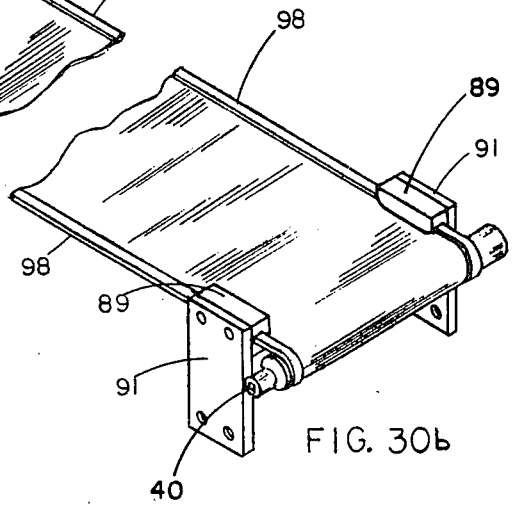
FIG. 30b

MULTIPLE FUNCTION INVALID BED ARRANGEMENT

BACKGROUND OF THE INVENTION

The process of transferring an invalid patient from a hospital bed to another bed surface or wheel chair in a hospital, nursing home, or home or assisting such a patient to get into a standing position often involves more than one person and is labor intensive and can be costly. It is occasionally a source of injury to the patient, nurses, or attendants who are involved in the means of patient transfer.

In addition, the process of changing bed sheets is an another labor intensive and often unpleasant task, frequently involving nurses or attendants in a hospital, nursing home, home, or maids in a hotel and can be costly.

Further, a relatively immobile patient in a sitting position in a hospital type bed which has its back section raised, often slides down toward the feet end of the bed and requires an attendant's or nurse's assistance to be raised back to a normal sitting position.

Further, other methods of transfer from a bed to another bed or surface often involve the person's body being moved over a hard or uncomfortable surface to a mattress or other surface at least during a portion of the transfer process. Another object of this invention is to provide means to accomplish the transfer from one bed to another bed or surface without the patient's body having to pass over such hard or uncomfortable surfaces(s).

Further, bed sheets often become rumpled or bunched in regions under and alongside a patient lying in bed making it uncomfortable for the patient. Another objective of this invention is to provide means to accomplish the straightening or rumple removal of the bed sheet.

The prior art associated with achieving the above objectives has almost exclusively involved the movement of the person or patient laterally or sideways across a bed. Although certain embodiments of the present invention involve lateral motion, it is a principal objective to provide other embodiments which move the patient longitudinally (i.e., lengthwise) with respect to a bed.

Principal objectives of this present invention are to provide a novel arrangement of parts or attachments which can be added and attached to existing or new beds or designed into new beds which will significantly assist in (A) the comfortable transfer of a person or patient from one bed to another bed or surface; (B) the changing of bed sheets on a bed; (C) the raising of a person who has slipped down from the raised back of a hospital bed, toward the top of the bed; (D) the tightening and straightening of the sheet on which a patient is reclining; (E) the positioning of a patient such that it reduces the manual work required to get the patient out of bed and (F) to perform (i.e., using certain longitudinal transfer embodiments of the invention) all of the above objectives without requiring the absence of bed side rails or other mechanical impediments alongside the bed. Other objectives will become evident from the description of the invention herein.

SUMMARY OF THE INVENTION

The present invention describes several arrangements which are similar in principle, which transfer or move a prone bedridden patient longitudinally along the long axis) or laterally (across the width) from a first bed to either (a) a second bed which has a similar arrangement, or (b) to another surface or apparatus which may or may not have a similar arrangement but has been designed or can be used to accept the patient's body.

The longitudinal bed transfer is accomplished by having the first (patient's) bed equipped with two rollers, one at the head and one at the feet end of the bed. A bed sheet about equal to the width of the bed, generally sectionalized and several bed-lengths long, is connected from the head to the feet roller, much like a piano roll. A motorized or hand crank arrangement is connected to the head and feet bed sheet rollers. A second bed which may be used to transfer patients to another location is equipped with a similar bed sheet and roller mechanism at its ends. The second bed is brought end to end, and at the same height, against the patient's bed. After the beds are clamped together, or otherwise prevented from moving, motors are actuated to turn the rollers on the patient's bed such that the bed sheet moves the patient lying thereon gently towards the second bed. At the same time, powered rollers on the second bed move its bed sheet at the same rate and direction at which the patient's bed sheet is moving, thereby gently transferring the patient to the second bed.

The bed sheet, as designated herein, may be made from pervious cloth as are normal bed sheets, it may have two or more layers of such cloth, it may have an impervious underlayer, or it may consist of two separable sheets, a conventional pervious upper sheet with one or more layers, and a lower sheet with one or more special qualities such as absorbancy, impermeability, high tensile strength, or low friction coefficient.

The identical principles as described above can be applied in the lateral transfer of persons except that the rollers would extend along the sides of the beds, and the person lying on the sheet would thereby be moved sideways from the first bed to the second bed. The reverse action of moving a person from a second bed or apparatus to the first bed is basically accomplished by reversing the rotation of the motors.

Another version of the invention is similar to a conveyor belt in that the sheet is continuous from the head or right side roller to the respective feet or left side roller and back again to the head or right side roller.

A further objective of the invention is to provide the additional bed sheet material, which may be sectionalized, and which enables the bed sheets to be changed by rolling the bed sheets until a new unsoiled sheet (or sheet section) covers the bed. The individual removable bed sheet sections can be conveniently removed for washing. This function can be used with the bed alone and is independent of its use for transferring persons.

Another important function of the bed which is used in longitudinal transfer arrangement, is to overcome a frequent source of discomfort in a hospital bed. When the back portion of a hospital bed is elevated, a patient sitting in the bed very often slides down toward the foot of the bed into a very uncomfortable position. The longitudinal transfer roller mechanism can be used to move the patient back into a comfortable position toward the head of the bed. This function is an additional objective of this invention, and it relates to use of the bed alone, and is independent of its use for transferring persons.

A closely related function of the rollers on these beds is for tightening, straightening and thereby smoothing a bed sheet under a reclining patient, in order to maintain the patient's comfort with minimal effort by a nurse or attendant. Many patients can use the bed roller controls to perform this task for themselves. The sheet straightening is done by using the rollers to move the sheet, with the patient on it, a short distance toward the foot and back toward the head of the bed (or from side to side in the case of lateral transfer rollers).

The pulling of the rollers in combination with the spreading action of sheet edge guidance blocks or other guidance mechanism provides the necessary sheet straightening and smoothing action.

In summary, it is an object of the present invention to overcome the disadvantages and limitations in the prior art. More particularly, it is an object of the present invention to provide a practicable and economical means (i.e., which can, if desired, be constructed as an attachment to a conventional or hospital type bed) for essentially automatically changing bed sheets on any type bed, raising a slumping patient toward the head end of a hospital bed, straightening and smoothing the bed sheet, transferring a disabled person from one bed to another bed or apparatus (such as a reclined wheel chair), and assisting in getting a patient out of bed in order to facilitate patient care in a home, a hospital, or a nursing home.

An additional object of the invention is to not impair the normal uses and mechanical motions of a hospital bed in raising the mattress under the back or the knees of a patient or raising or lowering the bed.

Figure 19:
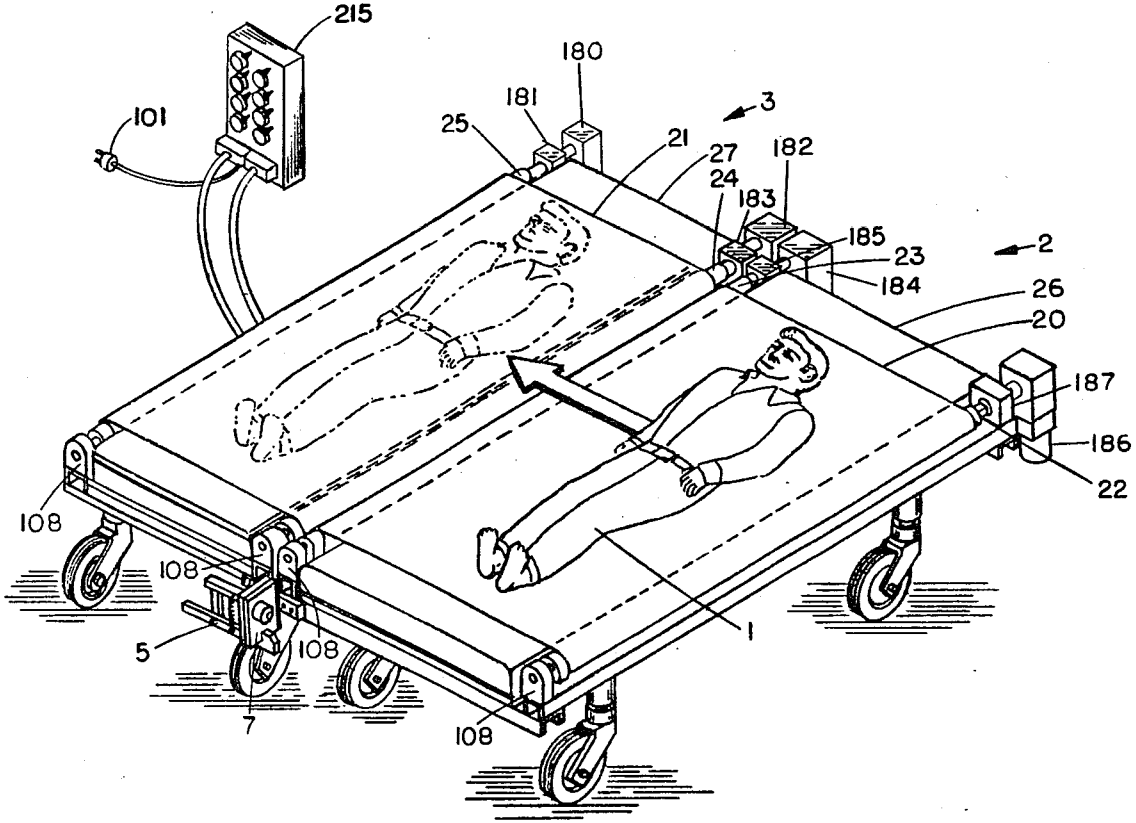
FIG. 19 is a perspective view and shows the principal components of a lateral bed transfer arrangement.
Figures 20, 20C:
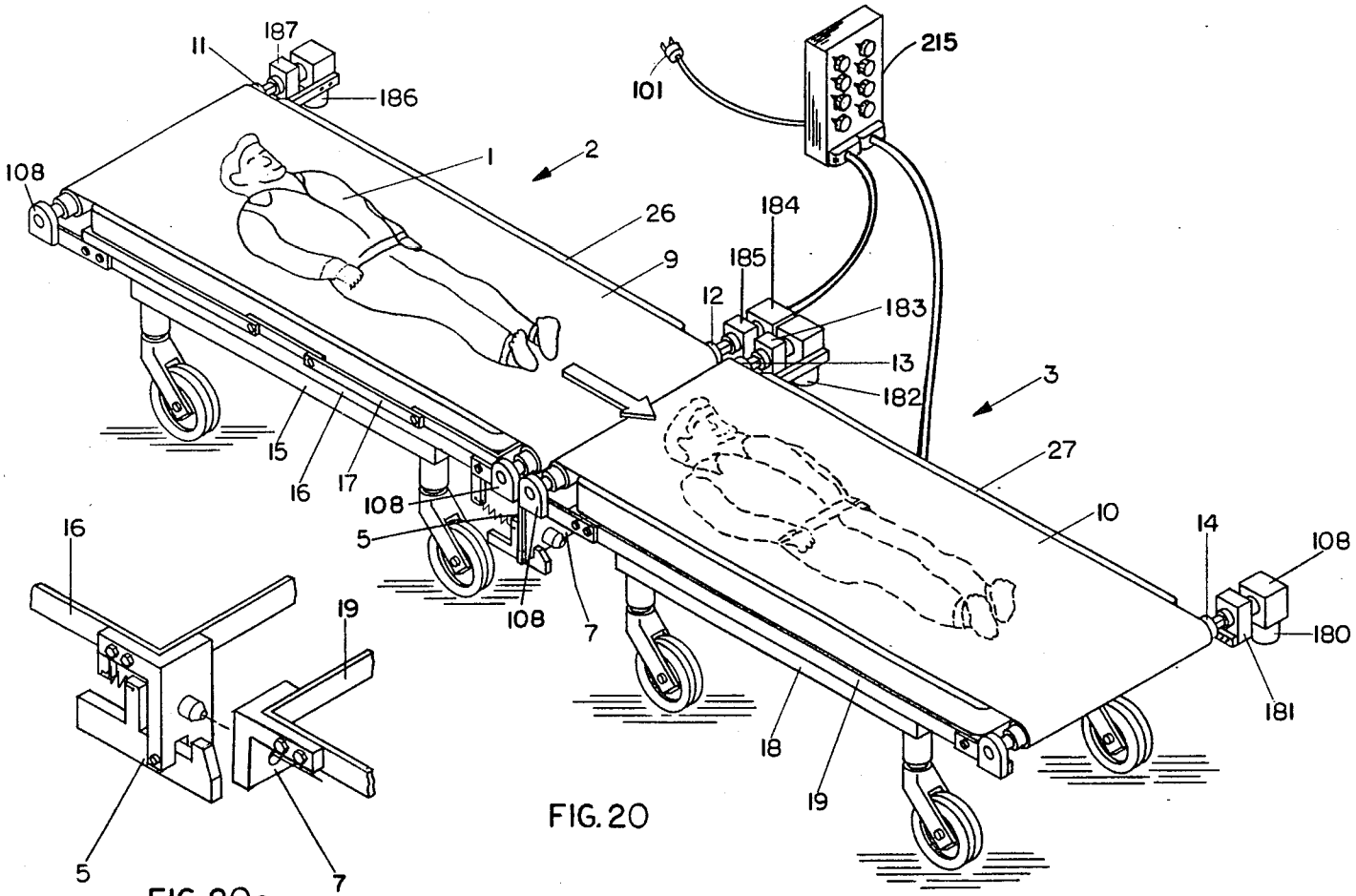
Figure 21:
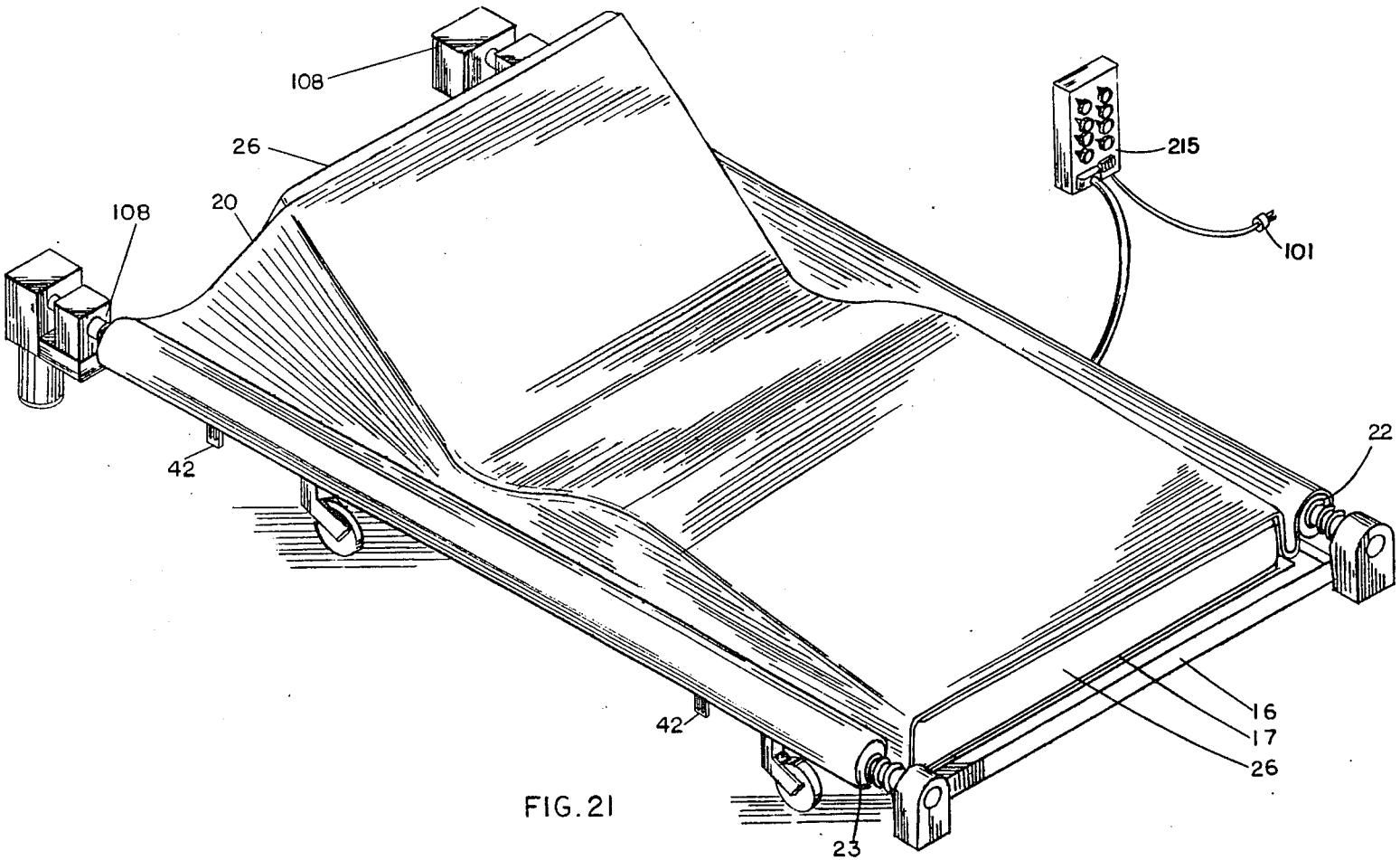
Figure 22:
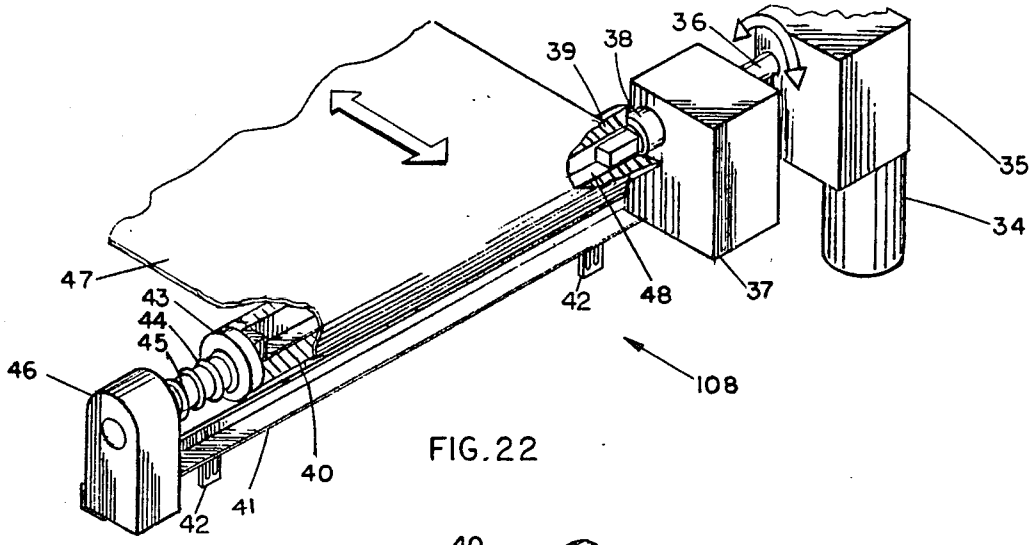
Figure 23:
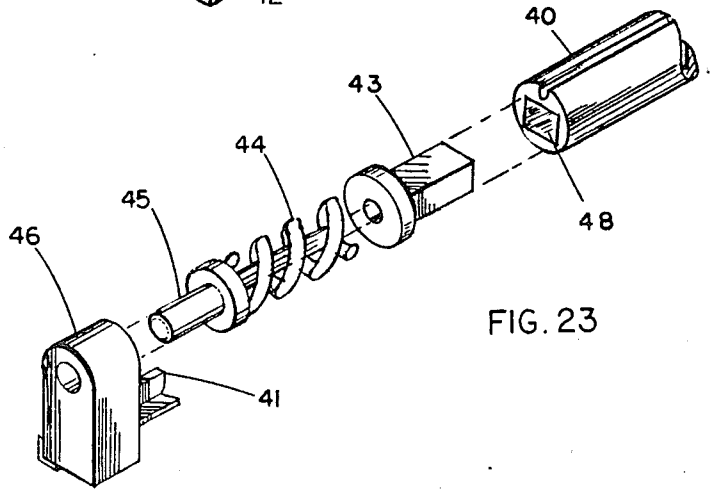
Figure 24:
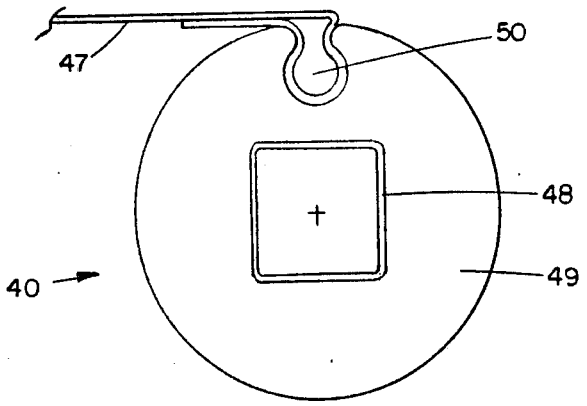
Figure 25:
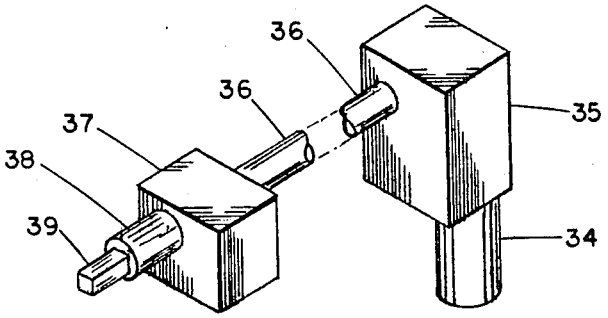
Figure 26:
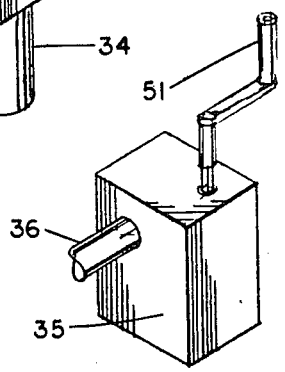
Figure 27:
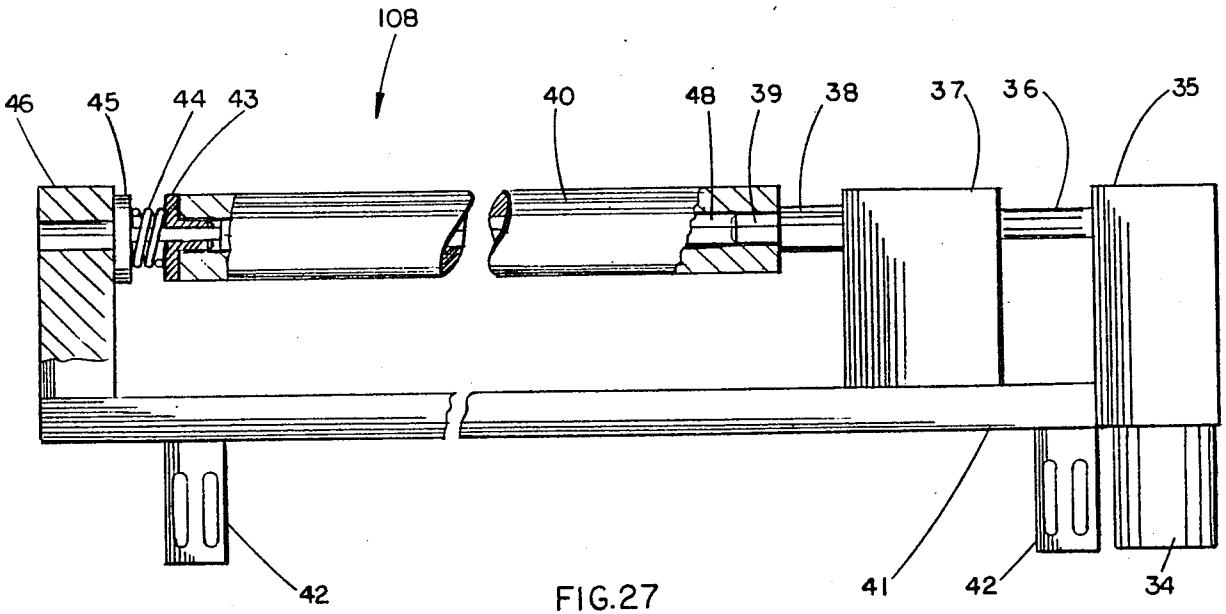
Figure 29A:
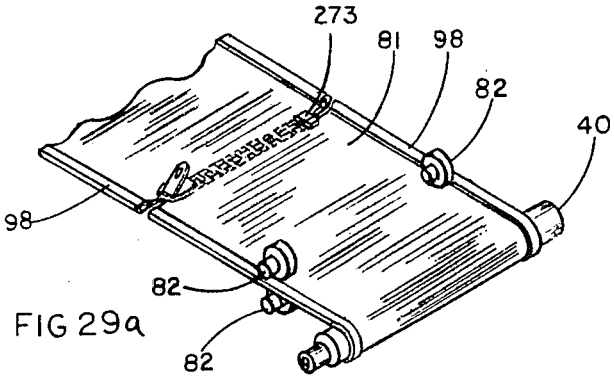
Figure 30:
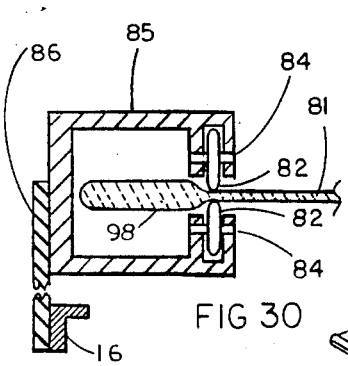
Figure 31:
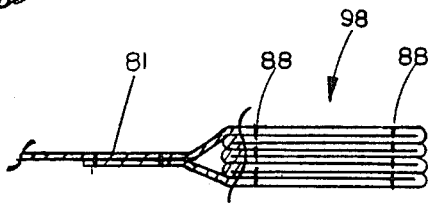
Figure 29:
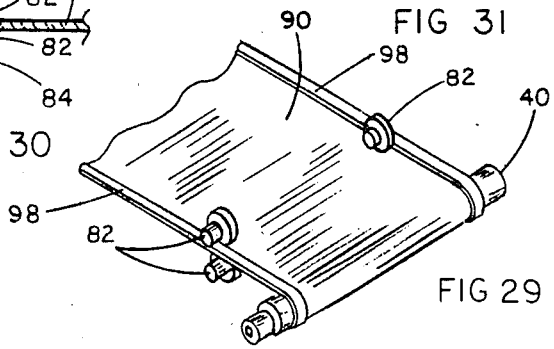
Figure 32:
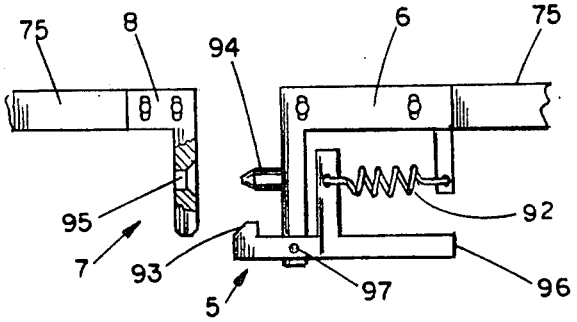
Figure 33:
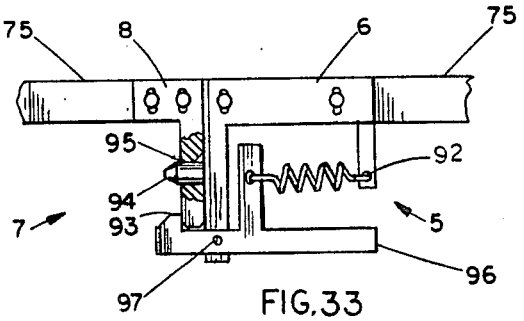
Figure 34:
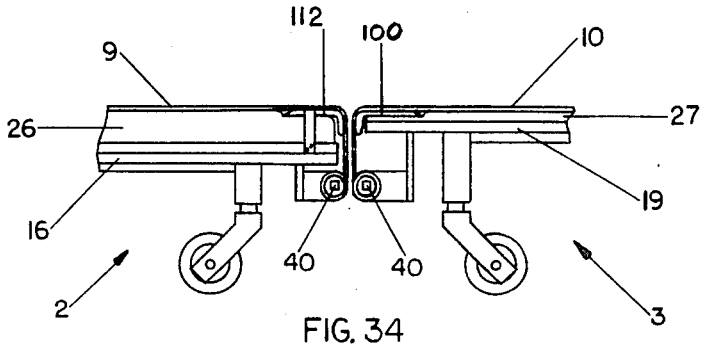
Figure 36A:
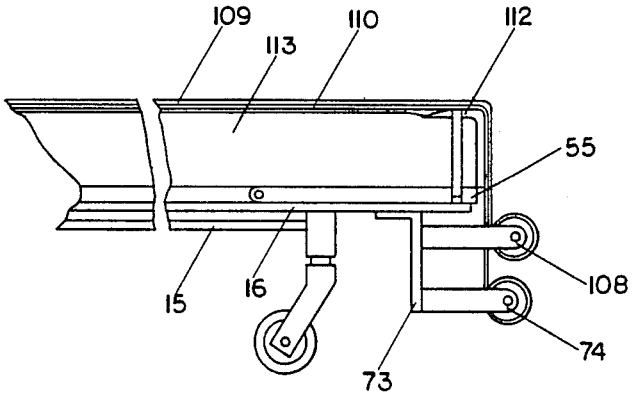
Figure 36:
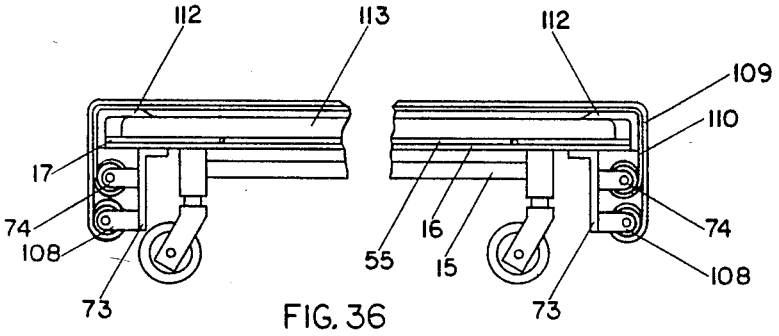
Figure 35:
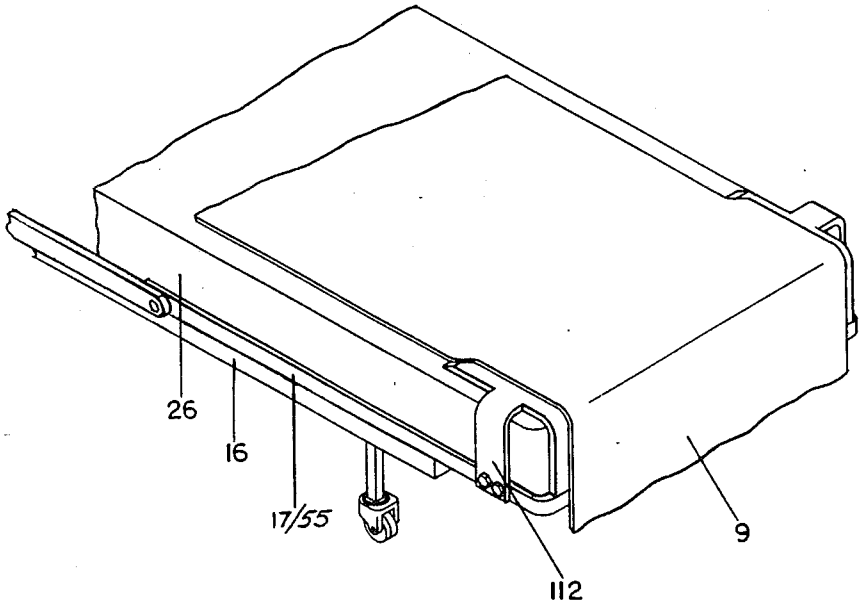
Figure 37:
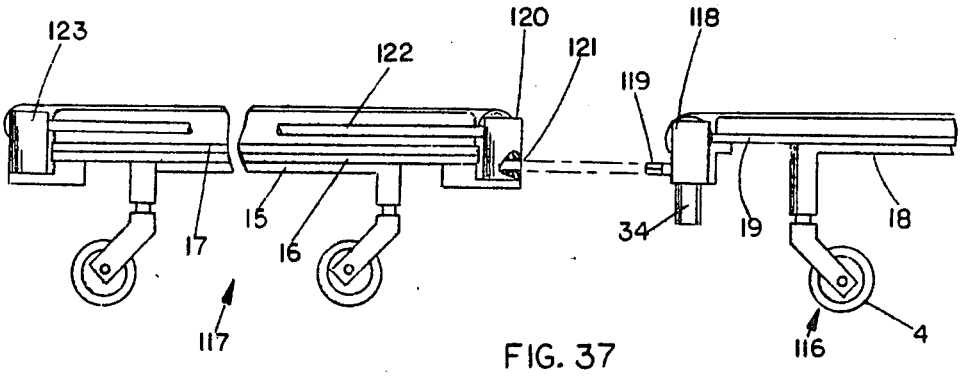
Figure 38:
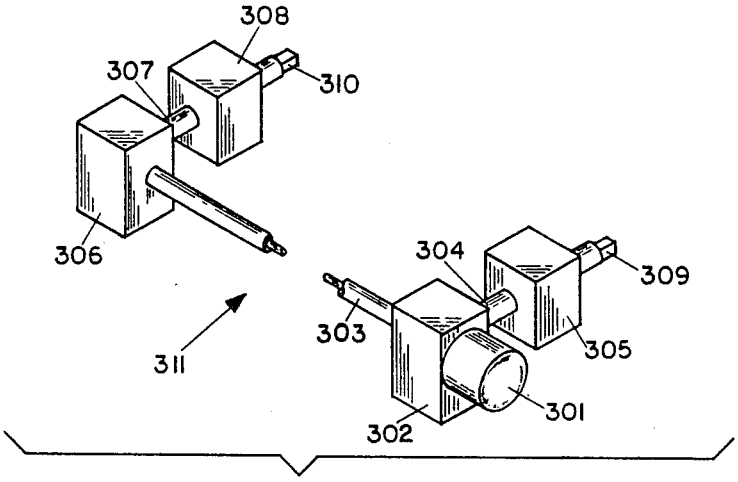
Figure 39:
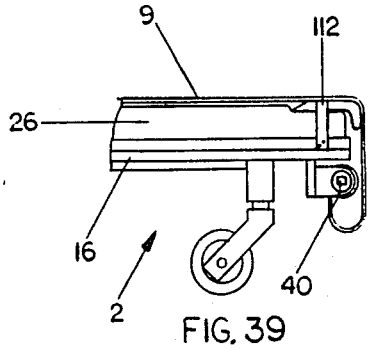
Figure 40:
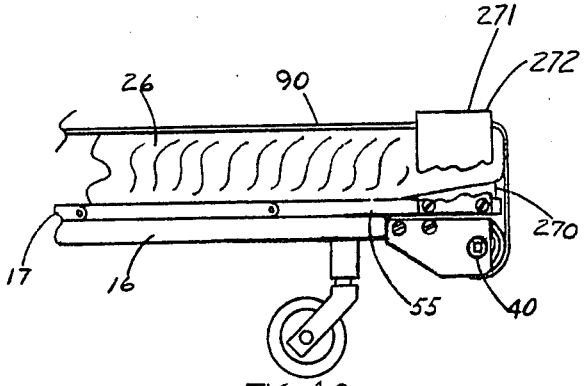
Figure 40A:
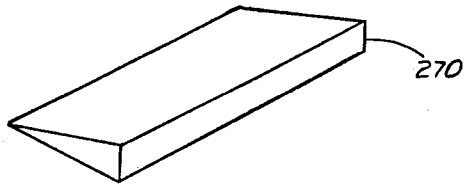
Figure 41:
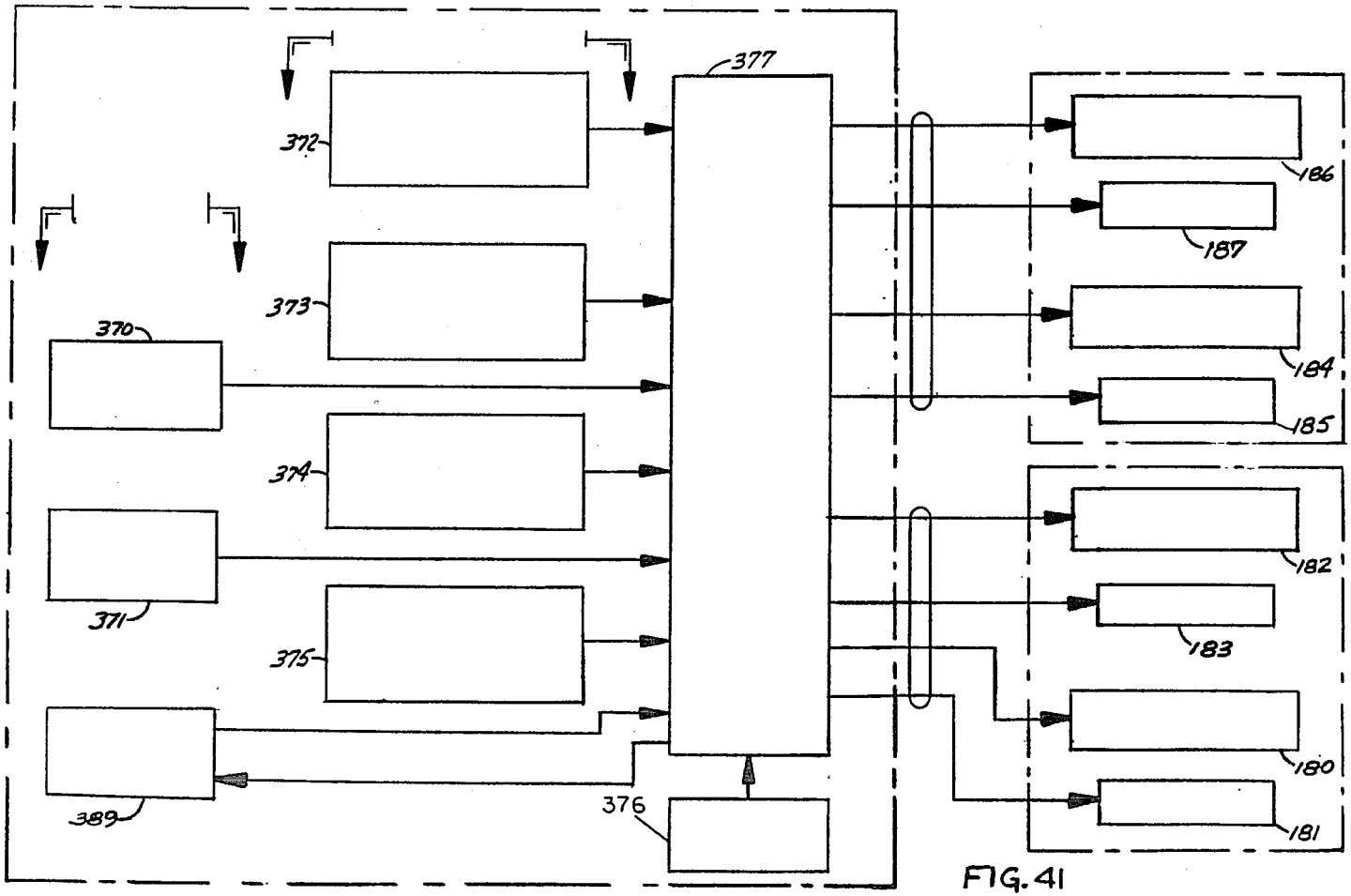
Figure 42:
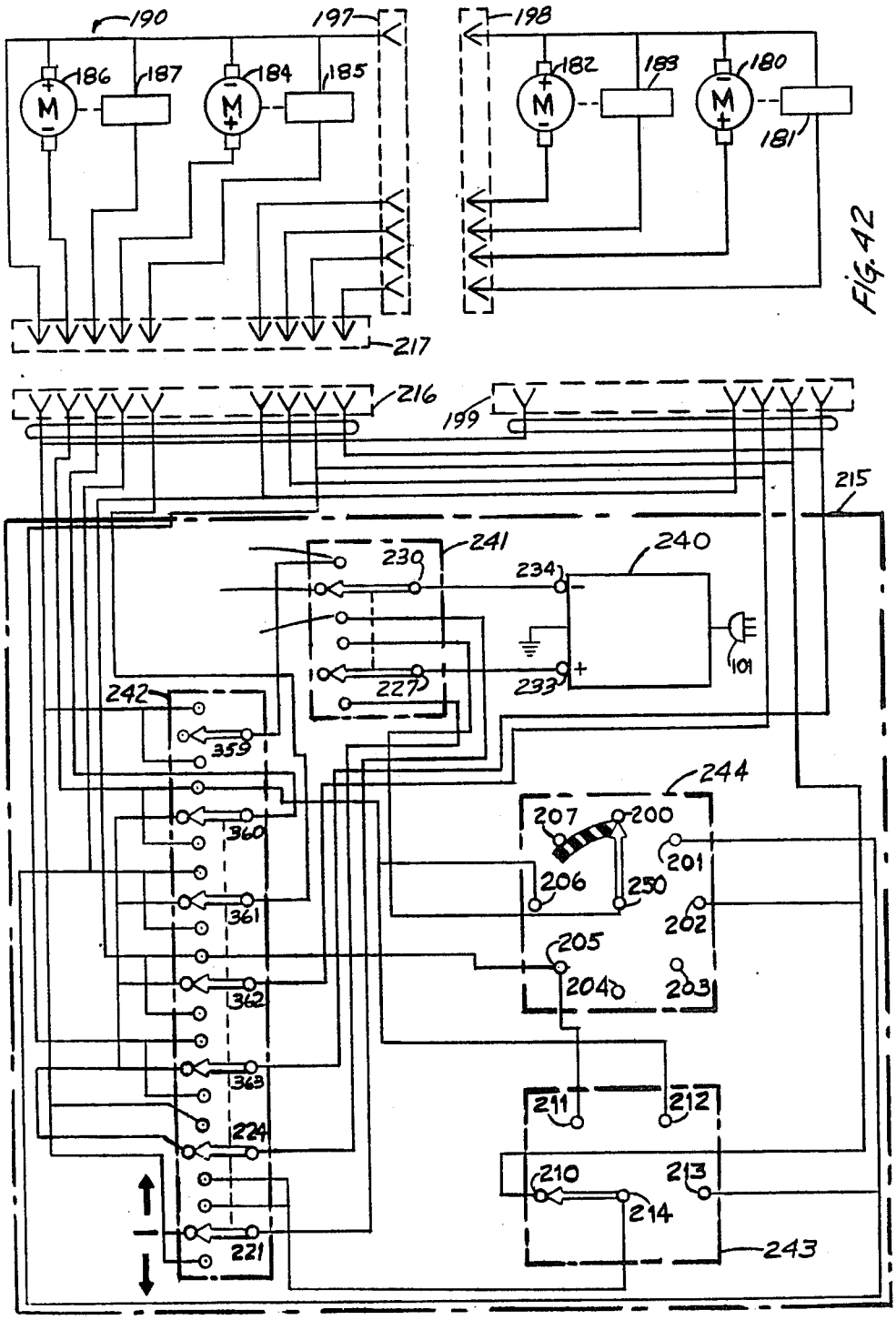
Figure 43:
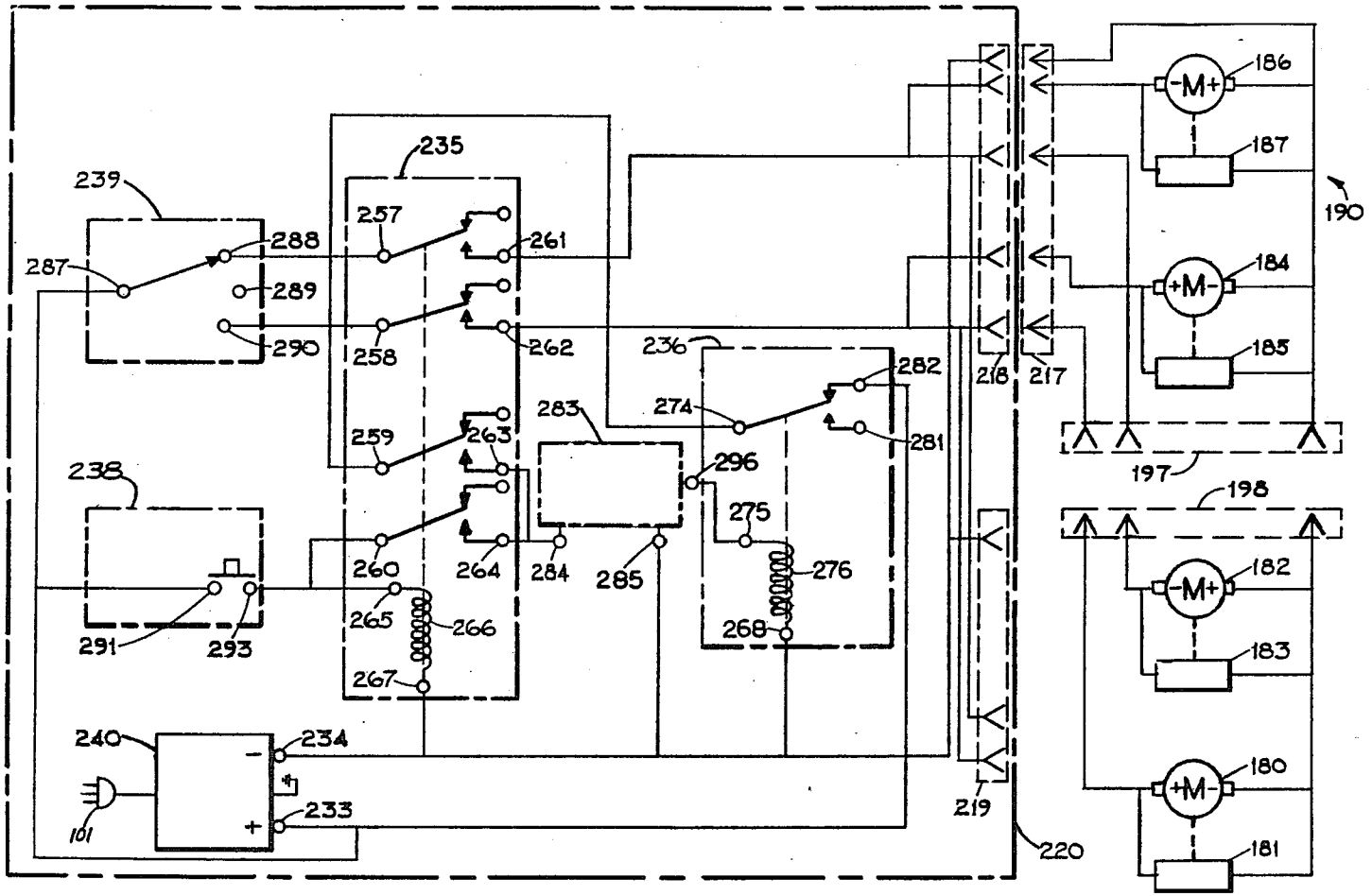

FIG. **19*a* is a perspective view of a similar transfer arrangement shown in FIG. 19**, where the second bed is replaced by a table;

FIG. **19*b* is a perspective view of a similar transfer arrangement shown in FIG. 19**, where the second bed is replaced by a fully reclined wheel chair;

FIG. 20 is a perspective view and shows the principal embodiment of the transfer arrangement of FIG. 19 for longitudinal transfer;

FIG. **20*a* is a perspective view and shows another embodiment of FIG. 20**, in which a fully reclined wheel chair is positioned at one end instead of at one side of the bed;

FIG. **20*b* is a perspective view of a double bed equipped with the transfer arrangement of FIG. 20**;

FIG. **20*c* is a perspective view of a linkage shown in FIG. 20**;

FIG. 21 is a perspective view of a hospital type bed equipped with a lateral transfer arrangement, according to the present invention;

FIG. 22 is a perspective view of a portion of a roller assembly;

FIG. 23 is an exploded perspective view of a portion of FIG. 22;

FIG. 24 is a schematic view of a portion of FIG. 22;

FIG. 25 is a perspective view of a part of the roller assembly shown in FIG. 22;

FIG. 26 is a perspective view of another embodiment of FIG. 25;

FIG. 27 is an elevation view of the roller assembly of FIG. 22;

FIG. 28 is a perspective view and shows an arrangement for removing or adding sheets from a roll, without removing the entire roll assembly from the bed;

FIG. **28*a* is a perspective view of another embodiment (thickened hem) of FIG. 28**;

FIG. 29 is a perspective view and shows an arrangement for providing proper tracking of the sheet assembly as it is taken up on the rollers;

FIG. **29*a* is a perspective view and shows another embodiment of FIG. 29**, which includes an arrangement for removing or adding sheets from a roll;

FIG. 30 is a cross-sectional view of a housing for restraining rollers used in the embodiment of FIG. 29;

FIG. **30*a* is a perspective view of a different embodiment of FIG. 30**, which uses restraining grooves in place of restraining rollers;

FIG. **30*b* is a perspective view and shows a different embodiment of FIG. 29**, which uses restraining grooves in place of restraining rollers;

FIG. **30*c* is a perspective view and shows a different embodiment of FIG. 29*a***, which uses restraining grooves over the juncture of sectionalized sheets in place of restraining rollers;

FIG. **30*d*** is a perspective view of a directed edge guidance block or directed restraining groove member which has the axis of its internal groove gradually shifting direction relative to the mounting bracket;

FIG. **30*e*** is a perspective view of the directed edge guidance block or directed restraining groove members mounted on a bed and its relationship to the flexible sheet material and mattress;

FIG. 31 is a schematic view and shows a method of building up a hem, as required in the embodiment of FIG. 30;

FIG. 32 is an elevational view of an alignment and latch assembly;

FIG. 33 shows the arrangement of FIG. 32 in latched position;

FIG. 34 is a side view and shows a bed and gurney in close proximity with roll asemblies mounted under the bed and gurney;

FIG. 35 is a perspective view of part of the bed shown in FIG. 34;

FIG. 36 is an elevational view and shows an arrangement for automatically changing under sheets, as well as a sheet in contact with the patient;

FIG. 36*a* is a side view of another advantageous embodiment of FIG. 36;

FIG. 37 is a schematic elevational view and shows an arrangement in which only gurneys are equipped with motors and the bed is operated from power take-off shafts from the gurneys;

FIG. 38 is a perspective view of a drive system for the tranfer bed using a single motor;

FIG. 39 is a side view of a roller assembly mounted underneath the bed, with slack in the sheet;

FIG. 40 is a side view of a bed with guidance blocks and a wedge under the end of the mattress;

FIG. 40*a* is a perspective view of a wedge used in FIG. 40;

FIG. 41 is a generalized electrical block diagram of an arrangement for automatic transfer and manually controlled transfer or bed sheet change or sheet movement;

FIG. 42 is an electrical schematic of a control circuit for controlling motors and clutches of FIGS. 19 and 20;

FIG. 43 is an electrical schematic of a control circuit for fully automatic transfer of a patient between beds, according to the present invention;

DESCRIPTION OF THE PREFERRED EMBODIMENTS

Referring to the drawing, FIGS. 1 to 5, illustrate schematically, the steps of moving a patient from a reclining position on a first bed to a reclining position on a second bed longitudinally.

Figures 1, 2, 3, 4, 5:
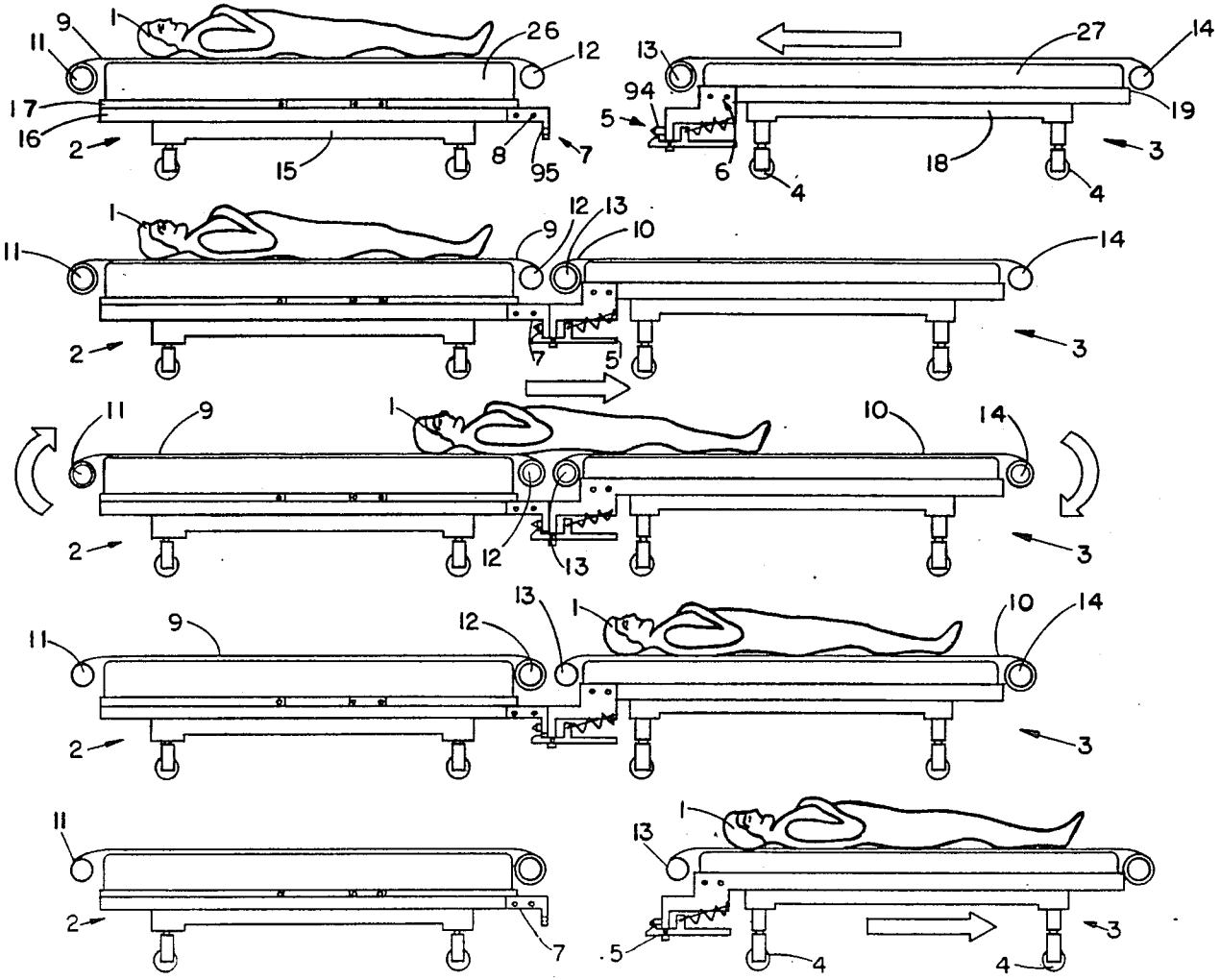
FIGS. 1–5 are schematic elevational views and show the steps of moving a patient longitudinally from a reclining position of a first bed to a reclining position on a second bed, according to the present invention.

In accordance with the schematic of FIG. 1, the first bed 2 is shown with a thicker mattress 26 and is schematically illustrative of a conventional bed found in the home or a hospital bed upon which a patient 1 is reclining. This bed 2 is constructed such that it has added to it, a cylindrical roller 11 approximately equal in length to the width of the bed and is mounted to the bed frame 17 at the patient's head end of the bed. A similar roller 12 is similarly mounted to the bed frame 17 at the patient's feet end of the bed. A bedsheet 9, which is schematically depicted by a single line, has approximately the same width as the bed and a length several times the length of the bed. One end of the sheet is fastened to and rolled on to the head roller 11 with the other end fastened to roller 12. A similar second bed 3 shown with a thinner mattress 27 than that of mattress 26 on the first bed, is schematically representative of a transfer bed which is sometimes referred to as a gurney bed. Rollers 13 and 14 are respectively mounted to the head and feet end of the transfer bedframe 19.

An elevation mechanism 15 is schematically representative of an elevation mechanism associated with a hospital bed. Similarly for the transfer bed, a schematic elevation mechanism 18 is shown.

Also schematically represented is an alignment pin 94. The male, alignment and latching mechanism 5, is fastened to the frame 19 by bracket 6. A receptacle 95, part of the female alignment and latching mechanism 7, is fastened by bracket 8 to bed frame member 16. These optional devices can be used to align the first bed 2 and second bed 3.

The horizontal arrows of FIG. 1 schematically represents the second or transfer bed being moved toward the first bed on wheels or casters 4.

The horizontal arrow of FIG. 3 schematically represents the patient 1 being moved from the first bed 2 to the second bed 3.

FIG. 2 illustrates both beds being joined together and in alignment by virtue of an optional alignment and latching mechanism. This mechanism shown in the schematics, keeps the two beds fastened together during the patient transfer operation. Alternatively, after a bed is maneuvered into approximate alignment with the other, other means such as wheel brakes, which are standard devices on many beds, can be used to keep the beds from moving during patient transfer. Accordingly, "optional alignment and latching mechanism" will be used in the drawings and text herein to designate either an actual alignment and locking mechanism or other means, such as wheel brakes, for holding the beds motionless.

The rotating arrow in FIG. 3 shows the action of rollers 11, 12, 13, and 14 rotating clockwise, either by manually powered mechanical or motorized means. The rollers are drawing the sheets across the beds and thereby are transferring the patient from the first bed (hospital or conventional bed 2) to the transfer bed or second bed 3, as indicated by the horizontal arrow.

FIG. 4 shows the patient transferred to bed 3;

FIG. 5 shows a transfer bed being moved away from the first bed as indicated by the horizontal arrow.

The reverse action of transferring the patient from the second bed to the first bed can be accomplished by reversing the sequence from FIG. 5 to FIG. 4 to FIG. 3 to FIG. 2 to FIG. 1, provided that rollers 11 and 13 are mechanically rotated counter-clockwise.

Referring to the drawing, FIGS. 6 to 10, illustrate schematically, the steps of moving a patient from a reclining position on a first bed to a reclining position on a second bed in a lateral manner.

Figure 6:
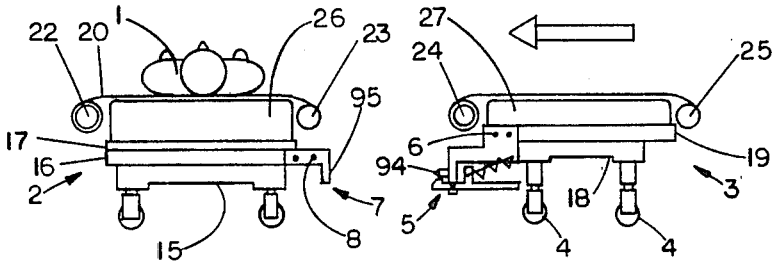
FIGS. 6–10 are schematic elevational views and show the steps of moving a patient laterally from a reclining position on a first bed to a reclining position on a second bed.

In accordance with the schematic of FIG. 6, the first bed 2 is shown with a thicker mattress 26 and is schematically representative of a conventional bed found in the home or a hospital bed upon which a patient 1 is reclining. This bed 2 is constructed such that it has added to it, a cylindrical roller 22 whose length is approximately equal to the length of the bed and which is mounted to the bed frame 17 at the patient's left side of the bed. A similar roller 23 is similarly mounted to the bed frame 17 at the patient's right side of the bed. A bedsheet 20 approximately equal in width to the length of the bed and whose length is equal to several multiples of the width of the bed, is fastened and rolled about the left side roller 22. The other end is fastened to roller 23. The structure is similar to a piano roll or scroll, except that the material being rolled or scrolled is a bed sheet constructed of material sufficiently strong to maintain its physical bed sheet integrity. By rotating the rollers the patient lying on a moving bed sheet can be moved to the left or right relative to the bed. Elevation mechanisms 15 and 18 are schematically representative of various elevation mechanisms known in the art and associated with a hospital or transfer or gurney bed. A similar second bed 3 shown with a thinner mattress 27 than that of mattress 26 on the first bed, is schematically representative of a transfer bed which is sometimes referred to as a gurney bed. Such beds are frequently used to transport a patient from his normal hospital bed to an operating room or some other location in the hospital. Cylindrical rollers 24 and 25 are respectively mounted t the patients left and right sides of the transfer bedframe 19. An optional alignment pin 94 and receptacle hole 95 which three-dimensionally register and align the first bed to the second bed when brought together, are also schematically represented. Optional latching mechanisms 5 and 7 which are actuated when the two beds are brought together and which can be manually released when they are brought apart are also schematically represented. The arrow of FIG. 6 schematically represents the second or transfer bed being moved to the first bed on wheels or casters 4.

Figure 7:
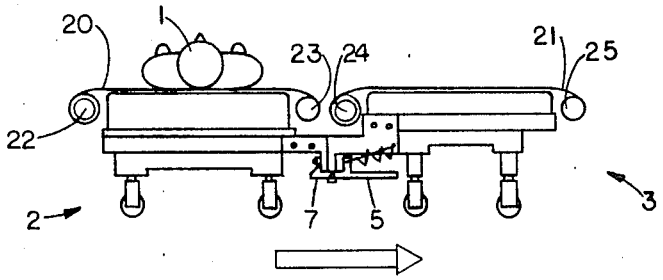

FIG. 7 schematically illustrates both beds being joined together and aligned by virtue of an "optional alignment/latching 5 and 7 mechanism". This latching mechanism or alternate means 5 and 7 keeps the two beds fixed relative to each other during the patient transfer operation.

Figure 8:
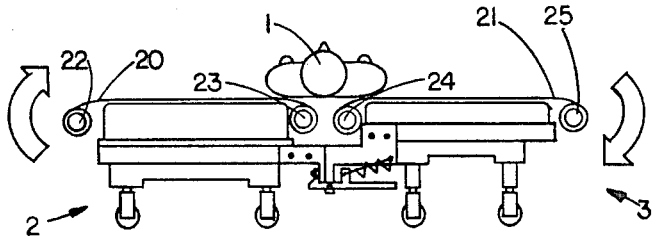

FIG. 8 shows the action of simultaneously rotating either by manual mechanical or motorized means, rollers 23 and 25 in a clockwise motion which transfers the patient from the first bed (hospital or conventional bed) to the transfer bed or gurney bed. FIG. 8 shows the patient midway between the hospital bed and the transfer bed.

Figure 9:
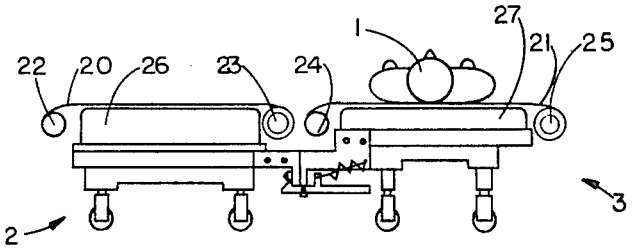

FIG. 9 shows the patient fully transported from the first bed to the second bed. During this roller rotational activity, the sheets unwind from the representative left side rollers of the first and second bed, onto the respective right side rollers of the first and second bed.

Figure 10:
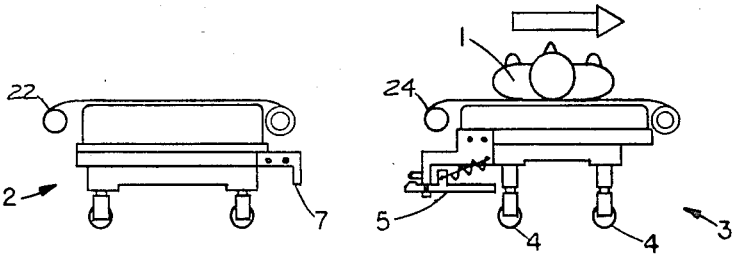

FIG. 10 shows a transfer bed being moved away from the first bed.

The reverse action of transferring the patient from the second bed to the first bed can be accomplished by reversing the sequence from FIG. 10 to FIG. 9 to FIG. 8 to FIG. 7 to FIG. 6, provided that rollers 22 and 24 0(not on drawing) are synchronously and mechanically rotated counter-clockwise.

Since the length of the sheets is equal to several or more multiples of the width of the bed, it can be seen in FIG. 9 that if roller 23 is rotated such that an additional length of bed sheet material is rolled on to roller 23, and then, if the patient is returned to the first bed by reversing the operations depicted in FIG. 10 through FIG. 6, the patient will lie on a clean or fresh section of the bed sheet. In other words, the bed sheet would have been changed. If such bed sheet is sectionalized in widths equal to or greater than the width of the bed, and fastened together by a fastening means such as a zipper, it can be seen that if the section that was rolled on to roller 23 were removed, with or without the cylindrical roller, immediately after the transfer of the patient off the first bed and before the additional length of bed sheet is rolled on to roller 23 that the new sectionalized bed sheet lying under the patient when returned to the first bed would not be contaminated by the soiled section.

It is clear that bed sheet changing can be done in the same manner with the longitudinal configurations of FIGS. 1–5, and can also be done in a single unoccupied bed, 2, in FIGS. 5 and 10.

It is clear that FIGS. 1–10 apply equally well to apparatuses which have the same general shapes and sizes as a bed and which are equipped with sets of rollers and sheets as means of transporting a person from one apparatus to another.

Figure 11:
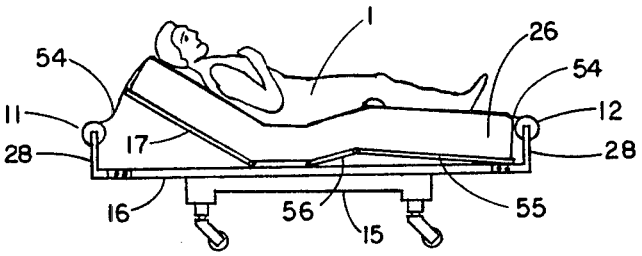
FIG. 11 is a schematic elevational view and shows a patient lying on a hospital-type bed equipped with longitudinal transfer bed arrangement.

FIG. 11 schematically represents a patient 1 lying on a hospital-type bed (i.e., with articulating mechanical members which elevate head, back and knees). It schematically shows the longitudinal transfer bed arrangement with the head roller 11 and foot roller 12 mounted via brackets 28 to the respective head and foot portion of the horizontal bed frame member 16 (i e., generally horizontal non-mechanically articulating member 16). It also shows that by appropriately rotating head 11 clockwise and foot roller 12 counter-clockwise that this enables the bed sheet arrangement of the longitudinal bed invention described herein to provide slack to the head and foot portions of the bedsheet 54 providing the extra bed sheet length required to allow the free mechanical articulation of the hospital bed frame members 17, 55 and 56, (i.e., members supporting elevation of head, back, and knees).

Figure 12:
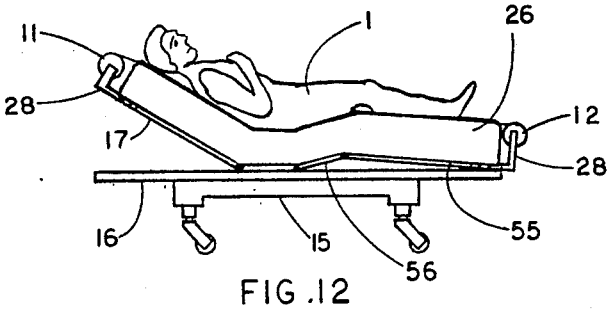
FIG. 12 is a schematic elevational view and shows another embodiment of the arrangement of FIG. 11.

FIG. 12 schematically represents the longitudinal bed transfer arrangement with the head roller 11 mounted via brackets 28 to the mechanically articulated member 17 of the hospital bed which elevates the head and back. Similarly, foot roller 12 is mounted via brackets 28 to the mechanically articulated member 55 under the knees and calves. In this configuration of the longitudinal transfer bed arrangement invention, when the bed is mechanically articulated as defined above, the payout or take-up of rollers 11 and 12 is either very little or not required at all since the rollers maintain their approximate relative physical relationship to the mattress 26.

This configuration has a special advantage in that, when the bed is in normal use as a hospital bed the rollers can be driven to return a patient, who has slid down to an uncomfortable position toward the foot of the bed, to his original position, and this can be done even with the bed remaining in its articulated position.

Figure 13:
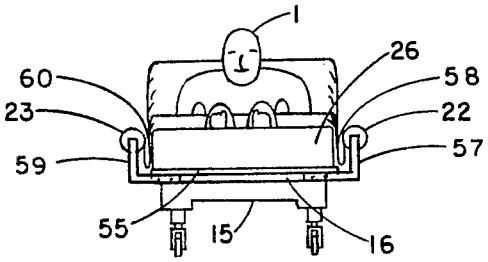
FIG. 13 is a schematic end view and shows a patient lying on a hospital-type bed equipped with a lateral transfer bed arrangement.

FIG. 13 schematically represents a patient lying on a hospital type bed, as defined above. It schematically shows the lateral transfer bed arrangement with the patient's left side roller 22 and right side roller 23 mounted via left side brackets 57 and 58 and right side brackets 59 and 60 to non-articulating frame member 16.

Brackets 58 and 60 are hidden from view in FIG. 13 as they are located at the end of the horizontal bed frame member 16 and they are in direct line with brackets 57 and 59. As can be seen from FIG. 13, the left side roller 22 has been rotated counter-clockwise and the right side roller 23 has been rotated clockwise (rotation from perspective of viewing FIG. 13) so that the bed sheet is slack, allowing the bed frame members 77, 17, and 56 (shown in FIG. 12) to be articulated.

Figure 14:
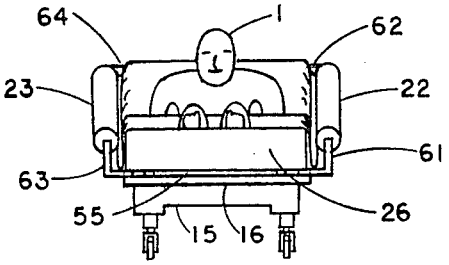
FIG. 14 is a schematic end view of another embodiment of FIG. 13.

FIG. 14 represents a configuration in which the side rollers are attached to the articulating members to reduce the amount of slack which is needed for articulation. Rollers 22 and 23 are mounted to their respective sides through brackets 61 and 63 to frame member 55 and brackets 62 and 64 to frame member 17 (which is shown in FIG. 12, but is hidden in FIG. 14).

Brackets 61 through 64 are designed to permit rollers 22 and 23 to tilt from the horizontal in accord with the position of bed frame members 17 and 55.

FIGS. 15–18 inclusive show a configuration of either the hospital, conventional home, or transfer bed which has mounted to it an idler roller on the left side and another idler roller on the right side of the bed for lateral transfer arrangement or a roller at the head end and a roller at the feet end of the bed in the longitudinal transfer-bed arrangement. FIGS. 15–18 differ from previously described figures or arrangements in that the bed sheet or other flexible material is wrapped around the opposite side or end rollers to function as a conveyor belt.

Figure 15:
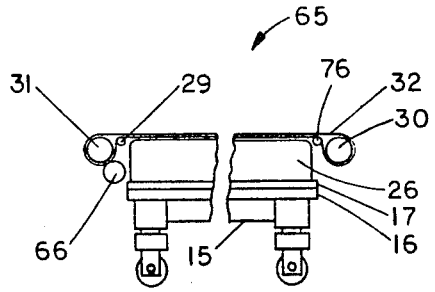
FIG. 15 is a schematic sectionalized view of a bed equipped with an arrangement of rollers and idler rollers for providing conveyor belt-type operation.

FIG. 15 is a schematically sectionalized view of a bed showing an arrangement of rollers and idler rollers which provide the conveyor belt type operation. In FIG. 15, rollers 31 and idler roller 29 are at one side or end of the bed 65 and roller 30 with its associated idler roller 76 is at the opposite side or end of the bed.

Figure 16:
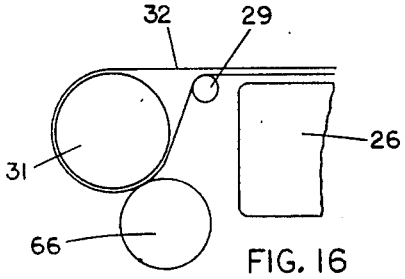
FIG. 16 is a schematic view and shows an expansion of the left side or end of the bed of FIG. 15.

FIG. 16 is an expansion of the left side or end of bed 65 of FIG. 15. In FIG. 15, the sheet material 32 is wrapped around roller 31 and over idler roller 29, over mattress 26, and on the other side of the bed over idler roller 76 and around roller 30 and back again to roller 31. The bed sheet material here is continuous.

In FIGS. 15 and 16, a driver roller 66 is shown schematically. This driver roller is held in compression by a spring or other device (not shown) against sheet 32 and roller 31 and has a moderately hard rubber-like surface with a high coefficient of friction. Therefore, as roller 66 is rotated clockwise, the bed sheet material 32 is pulled around roller 31 as roller 31 rotates counter-clockwise. This causes the upper portion of the bed sheet to move to the left in FIGS. 15 and 16 as it is pulled around idler rollers 30 and 76. The bed sheet material that is connected between idler roller 29 and 76 would therefore move to the right. Although the conveyor belt motion of the bed sheet 32 over the mattress 26 is moving in opposite directions and a certain amount of friction would exist particularly when a patient is supported upon a mattress 26, such friction can be overcome by the force of a driver roller 66 against roller 31. Suitable bed sheet material such as polyester and other materials known in the art, as well as conventional materials such as cotton would function satisfactorily in the configuration shown. Friction drag can be significantly reduced by using slippery coatings or layers of material on the inside surface of the sheet and the top surface of the mattress.

Figure 17:
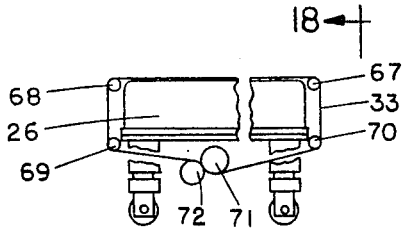
FIG. 17 is a schematic sectionalized view and shows an arrangement for avoiding frictional problems present in the embodiment of FIGS. 15 and 16.
Figure 18:
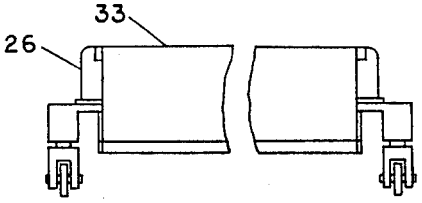
FIG. 18 is a schematic sectionalized view similar to that of FIG. 17 and shows an arrangement in which the supporting legs of the bed are extended beyond the length or width of a bed sheet.

FIGS. 17 and 18 avoid the frictional problem referred to above in FIGS. 15 and 16 by having the return path of a bed sheet 33 pass underneath the bed, thereby avoiding direct bed sheet contact with another portion of the bed sheet moving in the opposite direction. In FIG. 17, idler rollers 67, 68, 69, and 70 provide the idler roller functions for the bed sheet which traverses over and under the bed. The driver roller 71 in FIG. 17 and the roller 72 of FIG. 17 have the identical analogous functions of driver roller 66 in conjunction with roller 31 as described in relation to FIGS. 15 and 16.

FIG. 18 is a view of FIG. 17 and shows that for the configuration in which the bed sheet conveyor belt action goes over the top of mattress 26 and under the bed that the supporting legs of the bed would have to be extended beyond the length or width, as the case may be, of the bed sheet.

FIG. 19 is a perspective illustration showing the principal components of a lateral bed transfer arrangement. A second bed 3 is shown alongside a first bed 2 in which the patient is lying. An "optional pin and latching mechanism" 5 and receptacle mechanism 7 enable the first and second beds to be mechanicaly coupled and aligned together. Mechanisms 5 and 7 are shown in detail in FIGS. 32 and 33. A1ternatively, other means, such as wheel brakes, can be used for keeping the beds suitably aligned.

A roller assembly 108 consisting of a roller, a speed reducer, a mechanical rotating power source and a clutch assembly (further described by FIGS. 23–28) is mounted to each side of the first and second beds respectively. Each of the four roller assemblies shown have a roller length equal to approximately the length of the bed. Although all four roller assemblies 108 are identical, the rollers and clutches in these assemblies have been given different identification numbers for describing the operation in this and subsequent figures. Each of the rollers 22, 23, 24, 25 has an end of a sheet 20 or 21 fastened to it and each of them can be mechanically rotated in either a clockwise or counter-clockwise direction or locked in position or allowed to spin freely depending on a clutch 37 and a motor 34 shown in FIG. 22.

Note that in some configurations, discussed later, the clutches are not required and a single motor drive can be used.

As can be seen in FIG. 19, when rollers 22 and 23 on the first bed 2 are rotated clockwise, (as perceived from a reference position above the patient's head) then the sheet 20 upon which the patient is lying will be moved in such a manner as to transport the patient toward the right side of the bed (i.e. as perceived from the above reference position). If, when the patient just begins to leave the surfaces of the first bed 2, a switch or relay is used to start or mechanically power the roller assembly, driving rollers 24 and 25 in a clockwise direction at a rate which moves sheet 21 at the same rate as which sheet 20 is moving, then the patient will be continuously and smoothly transferred from the first bed 2 to the second bed 3 (sometimes referred to as a transfer or gurney bed). A manual control box 215 which can be used to control the rollers, is described in detail later.

FIG. **19*a* shows a similar transfer arrangement as in FIG. 19, except that a support with an essentially flat top surface 159, shown symbolically as a table, is used in place of a second bed. In this case rollers 22 and 23 will continue to operate to transport the person completely off the bed 2** and on to the support surface. This drawing shows that a transfer system consisting of two roller assemblies on the first bed can be used to transport a person, or to greatly ease the transport of a person on to another surface, especially a smooth slippery surface. In like manner, it is clear that if the person is pushed from the flat surface part way onto the bed surface, the transfer sheet, moving in the opposite direction, will draw him on to the bed and transport him to the center.

Figure 19A:
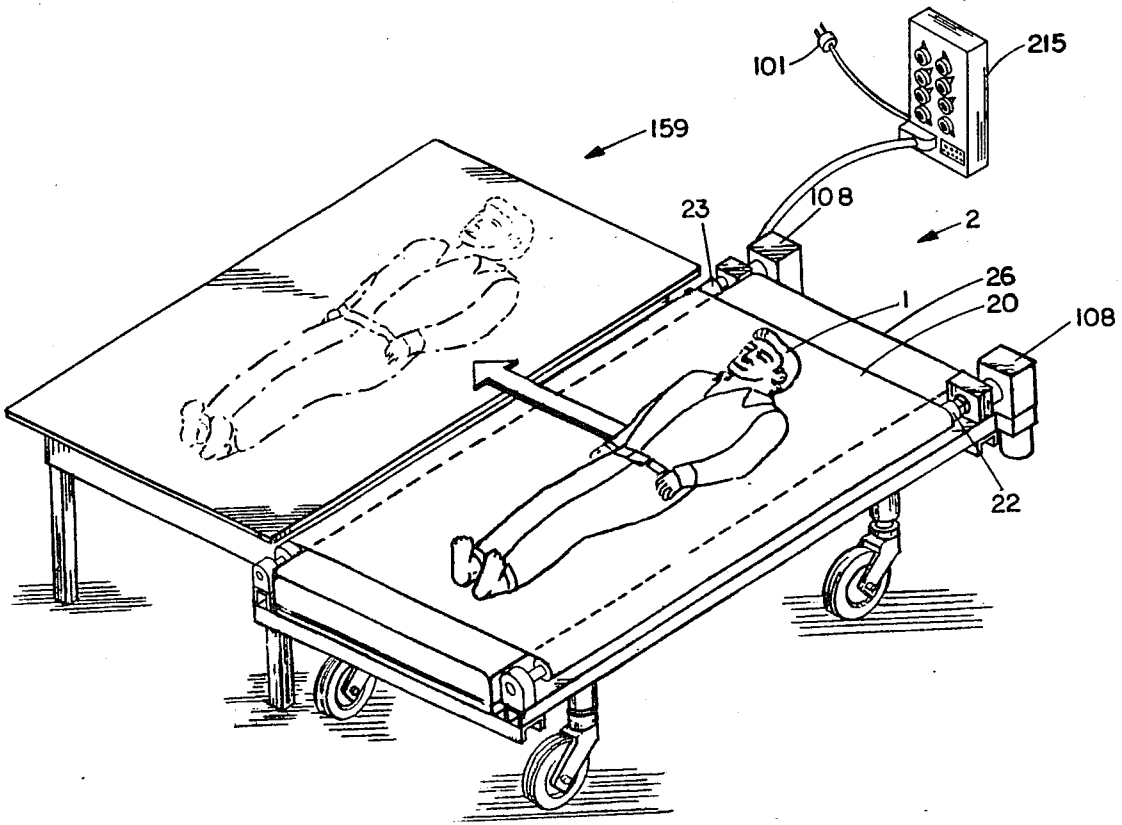

FIG. **19*b* is a virtually identical system, except that it shows symbolically a reclined wheel chair, positioned beside the bed, in place of the table shown in FIG. 19*a*. The top of the wheel chair is covered with a sheet of material 107 which is flexible to allow the back of the seat to be raised and the leg rest to be lowered, rotating about pivot points 105 and 106. The removable armrest on one side of the wheel chair has been removed to allow transfer of the person laterally from the bed on to the surface of the wheel chair. The wheel chair is shown fixed in position at the side of the bed by fold down legs 104. However, the tranfer operation is exactly the same as for the support in FIG. 19**. The wheel chair itself is not a subject of this invention; however, the invention does cover the use of the transfer system of the bed to transport or assist in the transport of a person to and from a reclined wheel chair as shown.

FIG. 20 shows almost identical transfer mechanisms except that roller assemblies 108 and their respective rollers 11, 12, 13, and 14 are mounted to the head and feet ends of the first and second beds and the optional alignment and coupling mechanisms 5 and 7 are also connected to the head and foot ends of the two beds. Except for the direction of motion, the transfer operation described with respect to FIG. 19 also applies to FIG. 20.

Figure 19B:
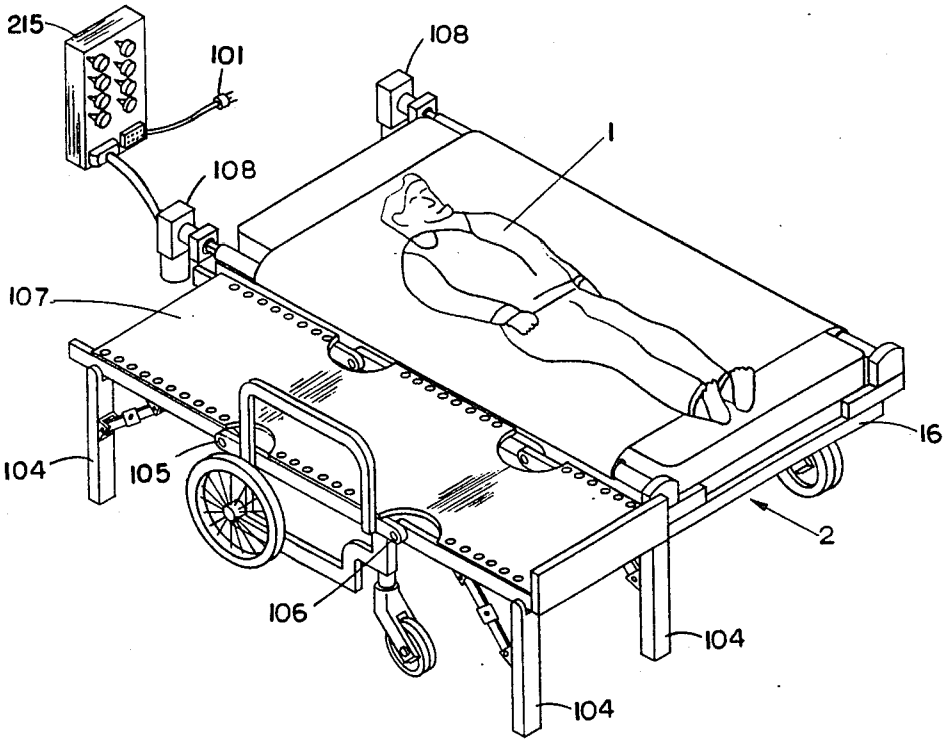
Figure 20A:
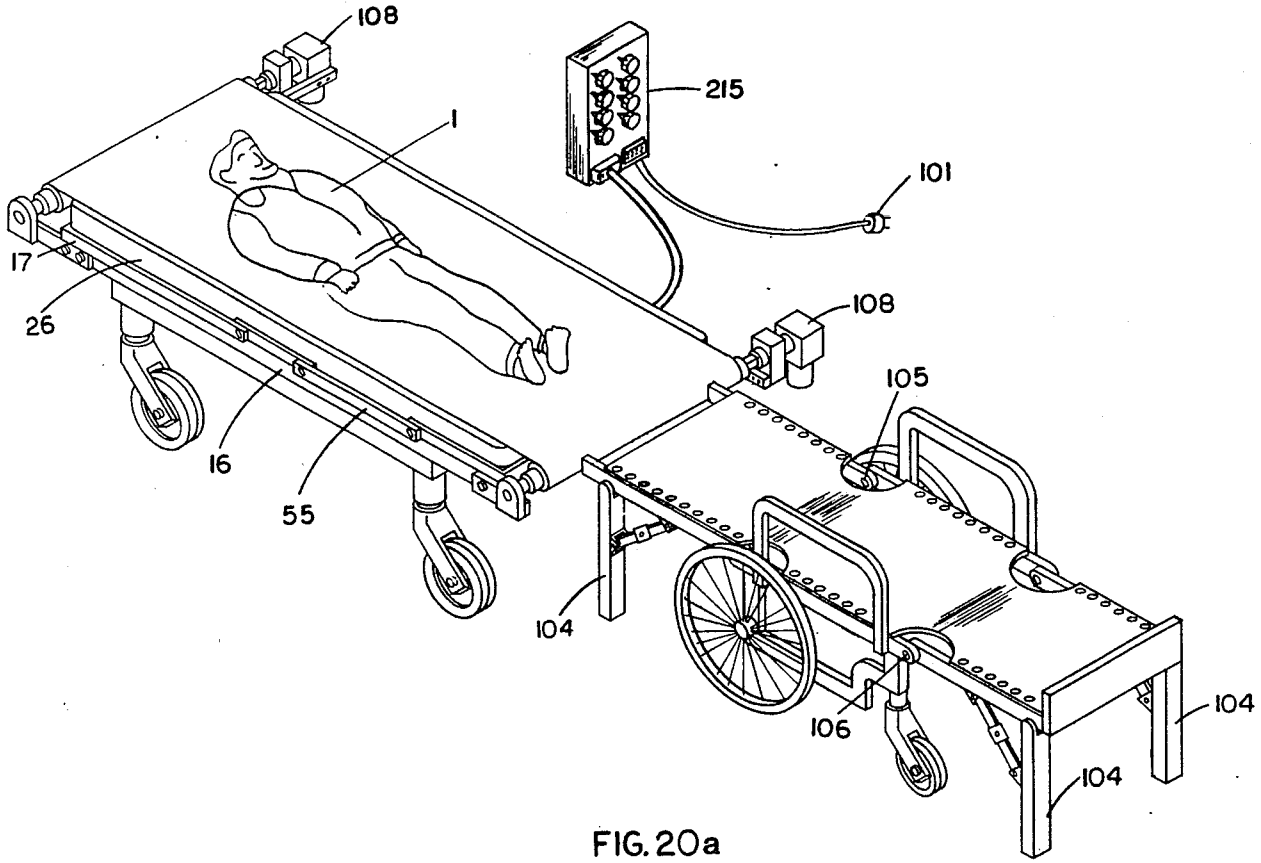

FIG. 20*a* shows an analogous longitudinal transfer mechanism which is similar to the arrangement shown in FIG. 20, in which the transfer rollers are positioned at the ends of the bed, and a fully inclined wheel chair with a smooth top is positioned at one end of the bed. The wheel chair is similar to the one in FIG. 19*b*, except that in this case, the wheels and arm rests which they extend above the seating surface of the wheel chair on both its left and right sides, would prevent the use of lateral transfer. As in FIG. 19*a* and 19*b*, the transfer system on the bed can be used to transport, or to greatly ease the transport of a person from the bed on to the surface of an extended or reclined wheel chair or other support, or from such smooth surface on to the bed in a similar manner as that described for FIGS. 19*a* and 19*b*. The invention covers the use of the transfer system of the bed to transport or assist in the transport of a person to and from a reclined wheel chair with arm rests or wheel member impediment located at the sides of the wheel chair.

Figure 20B:
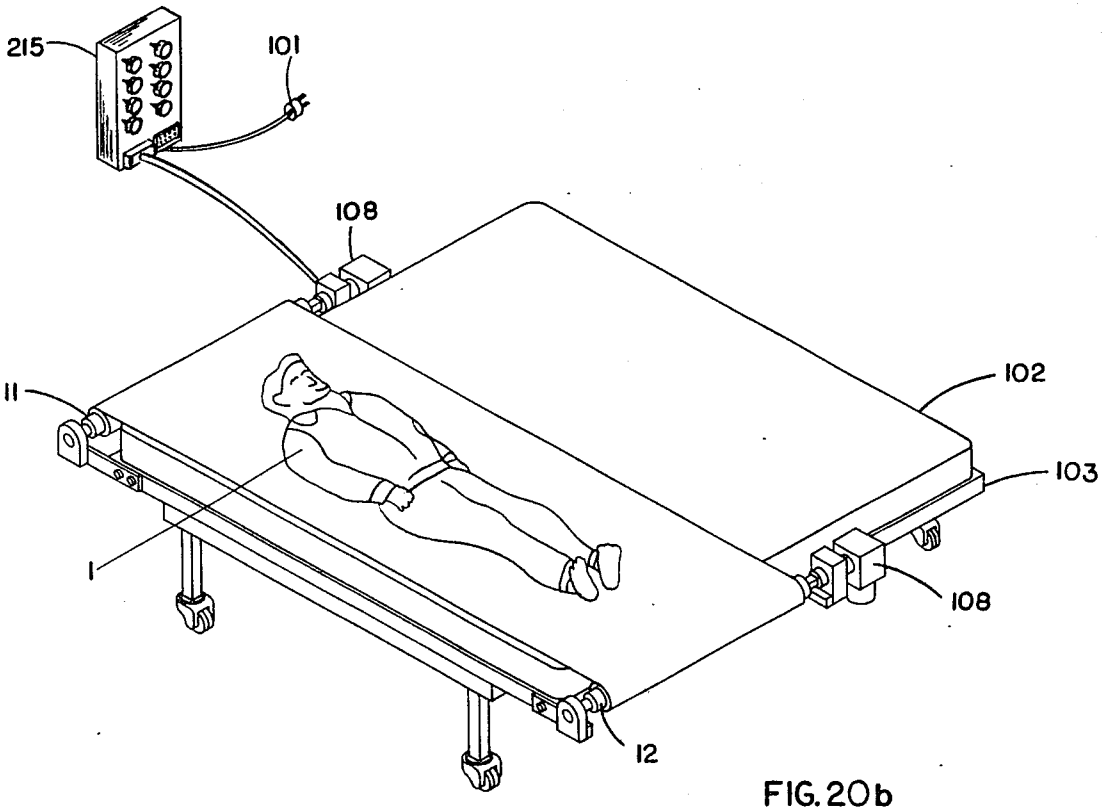

FIG. 20*b* shows a double bed in which half of the bed is equipped with a transfer mechanism which is substantially identical to the transfer mechanisms in FIG. 20 for a single bed. The transfer mechanism operates and is employed in the same way as on a single bed, as described for FIGS. 19 and 20.

FIG. 21 is a perspective view of a hospital type bed, which has mechanical articulated members to raise the head, back and knees of a patient and which incorporates a lateral transfer arrangement of the invention. It shows in perspective an implemention of the configuration of FIG. 13. It shows a roller assembly 108 fastened to the right side of bed 23, another roller assembly 108 can be fastened to the left side of bed 23 and bed sheet 20 which is provided with enough slack by rotating right side roller 23 in a counter-clockwise direction and left side roller 22 in a clockwise direction to allow the head and back and knee portions of the bed mattress 26 to be in their elevated positions without tension on the sheet.

The roller assembly and its associated drive mechanism is shown in drawings 22 through 27. One means of constructing a roller, among many that can be designed by those skilled in the art, is the roller 40 shown in a large scale end view of FIG. 24, which consists of a cylindrical formed shape of resistant foamed rubber or plastic 49 or other similar material with a hard, rigid hollow core 48. The core 48 material may be metal or other hard, rigid material to transmit torque and supply longitudinal stiffness to the assembly. The shape, shown square, may be any irregular shape to allow simple keying from the drive shaft 39 of FIG. 22.

As shown in FIG. 24, to fasten the sheet 47 to the roller 40, a longitudinal groove is provided in the outer surface. A spline 50 with a shape slightly smaller but matching the contour shape of the groove is provided. The sheet 47 is draped over the groove and the spline presses the sheet into the groove displacing the resilient sides of the groove in the roller material 49, and securing the sheet 47 to the roller 49.

In FIGS. 22 and 23, the roller 40 is supported at one end and driven by a shaft 39 suitably shaped to fit the roller core 48 with a sliding fit. This shaft 39 is supported by a bearing assembly 38 and driven through a suitable clutch 37. The clutch is driven by a shaft 36 from a speed reducer 35 which, in turn, is driven by a motor 34. FIG. 26 shows a speed reducer 35 driven by an alternate hand crank 51.

FIG. 27 and perspective view FIG. 22 show the speed reducer and clutch supported by a common frame member 41. This frame 41 provides adjustable brackets 42 for mounting to a bed. This frame 41 also supports tailstock bearing 46 in line and concentric with the center-line of the driving keyed shaft 39 and driving bearing 38.

The tailstock bearing and support assembly shown in FIG. 23 consists of the bearing 46, a shaft 45 comprised of two concentric cylinders with a common axis and separated by a larger flange. One cylinder fits into the bearing 46; the other into a hole in the tailstock support 43. The tailstock support 43 is shaped to fit into the center of the roller and has a flange on one end and a concentric thru-hole fitting the tailstock shaft 45. A compression spring 44 fits between the flanges on the shaft 45 and the tailstock support 43.

The spring 44 provides an axial force to push the tailstock support 43 into the roller.

To remove the roller and sheet one would grasp the roller 40 as shown in FIG. 27 and pull it toward the tailstock bearing 46, compressing spring 44 and sliding the hole in the tailstock support 43 over the tailstock shaft 45. When the roller core 48 clears the drive shaft 39 at the far end of the roller, the roller 40 is tilted and slid off the tailstock support. To install the roller, this procedure would be reversed.

An important object of this invention is the ability to remove or add a single sheet section or group of sheet sections to/from the roller without removing the complete roller assembly from the bed. FIG. 28 shows a roller assembly 40 with sheet sections fastened to it by means described before. Connecting the sheet sections is a full length zipper 52 with one half of the zipper sewn to one sheet section and the other half to the next sheet section. If this is done in series, then each end of the sheet will contain one half of a zipper. The zipper 52 is to be a separable type, as is known in the industry. The zipper is to be sewn on in such a manner that each sheet section shall contain on one end a zipper chain with attached slider and on the other end, a mating zipper chain without the attached slider. This will allow a series of individual sheet sections to be formed together into a continuous sheet, which is as long as required. The use of a zipper is only to illustrate one embodiment of a fastening means to fasten flexible sheet material sections together. Other means of fastening flexible sheet material sections together which are suitable for subsequently being rolled up on a roller are well known in the art.

The individual sheet sections may be approximately the same size as the top of the mattress or they may be somewhat longer than the bed length (or width, for the lateral configuration) so as to allow each section to be wound up one or more turns on each roller, for reasons of strength.

In some configurations of this invention, to assure proper operation it may be necessary to guide the sheet into proper alignment near the corners of the mattress or near the rollers. To provide such guidance, the hems of the sheet are thickened and the thickened hems are guided by wheels or rollers, or by blocks which contain restraining grooved guidance channels.

Figure 28A:
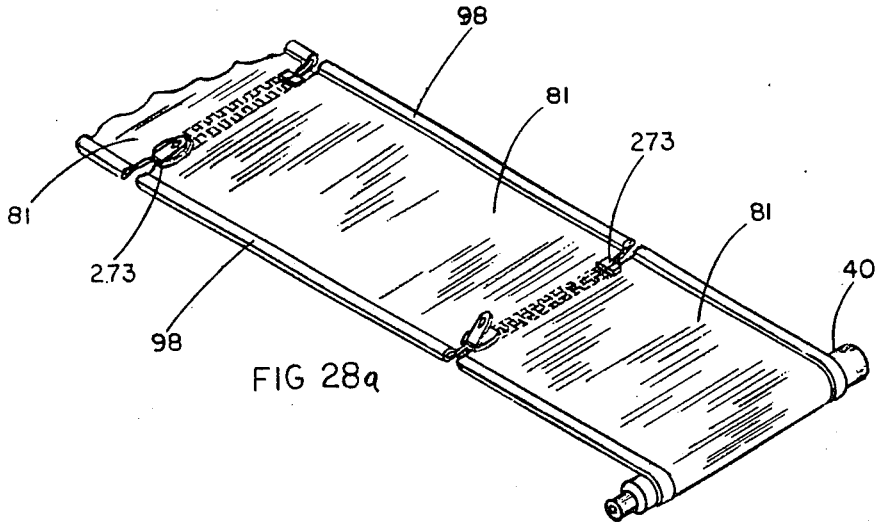

FIG. 28*a* shows a segmented sheet similar to FIG. 28 but which has thickened hems 98 and shortened zippers 273 to prevent the zippers from interfering with guidance wheels or channels.

FIG. 30 shows a set of guidance wheels (or rollers) 82 which are mounted in housing 85 and which rotate on axles 84. The spacing allows the sheet 81, but not the hem 98, to fit between the wheels. This housing 85 is fixed to the bed frame 16 by member 86 to correctly position the guidance wheels 82 near the sheet roller 40 as shown in FIGS. 29 and 29*a*. The two sets of guidance wheels which constrain the hems 98 on the sheet will keep the sheet aligned in spite of other pulls and stresses which may be applied to it. FIG. 29 shows the use of guidance rollers with a continuous sheet 90 and FIG. 29*a*, with a segmented sheet 81 with zippers 273 between the segments.

FIG. 30*a* shows an alternate method of guiding the sheet using a block 89 on mounting bracket 91. The block 89 which contains a guidance channel through which the sheet hem slides and a narrow slit, slightly wider than the thickness of the sheet, through which the sheet slides. The guidance channel and slit and its surfaces are made slippery by a smooth finish or a coating such as teflon. Both ends of the groove and slit are enlarged with a suitable taper to allow easy entry of the sheet from either end or to allow entry guidance of the thickened hems of each separate sheet section, which may not be precisely aligned with the preceding sheet section.

FIG. 30*b* shows the placement of guidance blocks 89 which are mounted by brackets 91 to the frame of the bed (not shown) near wind-up roller 40. The thickened hems 98 are shown passing through the channels in the guidance blocks to align the sheet on roller 40.

FIG. 30*c* shows a similar use of the guidance blocks 89 with a segmented sheet, 81.

Figure 30D:
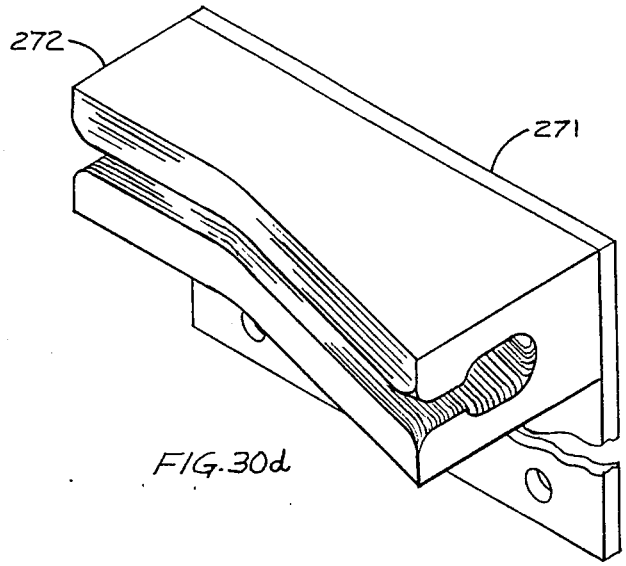

FIG. 30*d* shows a directed edge guidance block 272 whose guidance or restraining grooves are angled or directed toward its mounting bracket 271 and then directed parallel to the bracket.

Figure 30E:
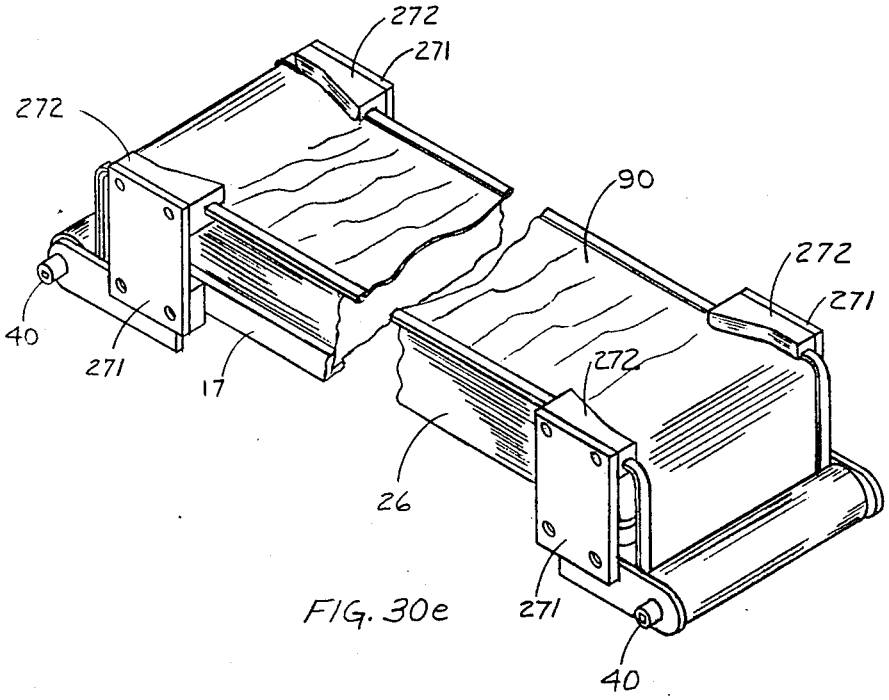

FIG. 30*e* shows four directed edge guidance blocks 272 mounted at the four corners of a bed (longitudindal or lateral) such that its internal grooves guide the thickened edges at each side of the sheet 90 (or sheet 81) outward (i.e., toward the outside edges of the sheet or mattress). This guidance or restraining action causes the sheet to become increasingly taut as it approaches the end of the bed. In this way, the sheet can absorb a larger portion of the stress due to the weight of a person's body as it passes over the edge of the mattress 26 and therefore, will reduce the sag in the mattress edge in the case where the roller is mounted beneath the mattress level and the bed is without the use of a platen such as described for FIGS. 34 and 35. This will enable the patient to pass over the end or side edges of the bed without feeling the discomfort of a hard or semi-firm roller underneath. FIG. 40 shows one embodiment using such directed edge guidance blocks 272 mounted on bracket 271 in conjunction with a wedge 270 under the mattress.

Another advantage of the use of the directed edge guidance block, whose length can be as long as required, is that the stress on the sheet is gradually increased and is distributed along a greater length of the sheet. FIG. 31 shows one method of building up the hem 98 as shown in the previous figures. The edges of the seet 81 are folded over a multitude of times and sewn (88) together to form a thick hem on each side.

It is clear that many other means can be used to provide a suitable shaped and strengthened thickened edge for the sheet. These include but are not limited to the use of ropes, cords, and belts made of different types of material which are securely hemmed, sewn or otherwise attached to the body of the sheet. If the thickened hem or thickened edge of the sheet is made sufficiently wide, the build up on the roller will be orderly.

The outer portion of the take-up roller under the thickened edges of the sheet may have a smaller diameter (not shown in the drawings) to prevent excessive build up of the thickened edges as the sheet is wound up on the roller.

Alignment/Latch Assembly

To insure proper transfer operation, the bed and gurney must be aligned to the proper height and location with each other. In addition, they must be kept in this alignment and not allowed to move relative to each other during transfer of a person. FIGS. 32 and 33 show a device which can be used for these functions.

The female latch assembly 7 is fastened by an adjustable bracket 8 to the bed or gurney frame 75. It consists of an alignment hole or tapered inlet 95 that allows and guides a suitably shaped and tapered pin 94 into the hole when properly aligned. This pin 94 is attached by an adjustable bracket 6 to the frame of gurney or bed 75 not used by the female assembly.

To latch the gurney to the bed, the gurney is aligned with the bed and pushed into it. As in FIG. 32, as the pin 94 approaches the opening 95, it will further align the two beds. The taper on the front of the latch 93 will cause the latch to pivot down to the left (ccw) about pin 97. Spring 92 is set to apply a clockwise or upward force to the latch 93. When both portions of the latch are in contact, the lever 93 will pivot back by spring force to the position shown in FIG. 33. At this point, the bed and gurney will be in alignment and latched. After operation, when it is required to separate the bed and gurney, lifting lever 96 will unlatch the latch hook 93 and allow the units to separate.

To conserve space and allow the beds to approach closer to each other, it may be desirable to mount the sheet rollers under or at the sides or ends of the bed or transfer bed (gurney).

Side view 34 shows a bed 2 and gurney 3 in close proximity with the roller assemblies 40 mounted under the bed 2 and gurney 3. To allow the respective bed sheets 9 and gurney sheet 10 to pass around the corner of the bed mattress 26 and gurney mattress 27 corner platens 112 for the bed mattress and 100 for the gurney mattress are provided. These platens are fabricated from stiff metal, plastic, or hard rubber material to distribute the weight of a person being transferred so as to reduce local sagging of the mattress. The top surfaces of the platens are made slippery to the sheets which slide over them. A platen can rest on a mattress 26 or 27 with no firm attachment to the bed frame 19, as shown for platen 100 on the gurney bed, or it can be firmly attached to the appropriate parts of the bed frame 16, as shown for platen 112. FIG. 35 shows an isometric view of the bed with platen 112 attached to an articulating member of the bed frame, 17 or 55.

FIG. 36 demonstrates a system that allows one to automatically change the under sheet 110 as well as the normal sheet 109 in contact with the patient.

The system consists of four roller assemblies mounted two on each side on a common bracket 73 fixed to the bed frame 16 at the ends or sides of the bed. The innermost pair of roll assemblies 74 pulls the under sheet 110 around the corners of mattress 113 over corner platens 112. The outer pair of roller assemblies 108 transports the patient as it pulls the normal sheet 109 over the under sheet 110. Sheet 109 is supported at the corners by the under sheet 110 resting on platens 112.

In operation, the outer rollers 108 with the normal sheet 109 can act as described before in transferring a patient or changing a sheet with no action required of the under sheet 110 and inner rollers 74.

To change the under inner sheet 110, the inner rollers 74 can be driven at the same time and in the same manner as the outer rollers 108 in transporting the patient off the bed. The under sheet 110 is constructed in the same manner as the standard sheet 109, except for the material and it can be changed in the same manner and at the same time as the normal sheet 109 described above. The patient or a new patient can then be returned to the bed.

FIG. 36*a* shows a different and advantageous orientation of rollers 108 and 74 from that shown in FIG. 36. Note that in FIG. 36*a* the rollers 74 and 108 are oriented so that the upper surfaces of the normal sheet 109 and under sheet 110 are facing inwardly toward the centers of the rollers 74 and 108 as the two sheets are wound up. In this way the soiled upper surface of a soiled sheet is on the inside of each layer in order to contain the soiling material and minimize the chances of contamination of adjacent sheet sections. As described earlier the wound-up soiled sheet or sheets can be unfastened from the clean sheets and the entire roller can be removed with the soiled sheets still rolled up and sent for laundering. It is apparent that the advantages of the different orientation of the roller and sheet of FIG. 36*a* apply to a single roller at each end or side of a bed.

It may be desirable to equip only the beds or only the gurneys with motors and make the unpowered unit operate from power take-off shafts from the powered unit. One such scheme is shown in FIG. 37 schematically. The bed without motors 117 is adjusted so that its foldable frame 17 is flat and the height is adjusted so that the PTO (Power Take-off) socket 121 is at the same height as the PTO shaft 119 of the gurney with PTO 116. The gurney 116 is aligned and wheeled so that the PTO shaft 119 enters and mates with the PTO socket 121. Motor 34 is bidirectional and drives gear box 118 and output shaft 119, which drives socket 121 and gear box 120, which in turn drives flexible shaft 122, which in turn drives speed reducer 123. The motor, PTO shaft 119 and flexible shaft 122 all rotate at the same speed with no speed reduction, and all of the roller drive output shafts from gear boxes 118 at the head of the gurney, 120 at the foot of the bed, and 123 at the head of the bed rotate at a common reduced speed. The patient is transfered by selective actuation of the respective clutches attached to the gear box roller drive output shafts as previously shown.

To transfer from the bed to the gurney, the clutch at the foot of the bed driven by speed reducer 120 would be engaged and the motor 34 would be started to move the patient towards the gurney; the other clutches at the head of the bed and at both ends or sides of the gurney would not be engaged. As the patient reaches the gurney, a manual switch, or a time delay relay or other automatic or manual means would actuate a motor drive at the foot of the gurney not shown to move the patient onto the gurney. To transfer from the gurney to the bed, the motor 34 would rotate in the opposite direction, the clutch at the head of the gurney driven by speed reducer 118 would be engaged to deliver the patient to the bed and then the clutch at the head of the bed driven by speed reducer 123 would engage to complete the transfer to the bed. The clutches at the foot of the bed and at the foot of the gurney would remain disengaged. When complete, the gurney bed 116 would be removed by moving it on wheels or casters 4.

In like fashion, the roles of the bed and the gurney could be interchanged with a motor in the bed supplying power to a gurney or to an apparatus to which a patient is to be transported.

It is also apparent that a separate power unit can be attached to power the rollers on a suitable equipped transfer device.

FIG. 38 represents in perspective view, a drive system for a bed (not shown) that uses a single motor to drive either roller on a bed equipped with a longitudinal or lateral transfer/bed changing system as described elsewhere herein.

Motor 301 is mounted to and drives gear box 302. This gear box has two output shafts. Interconnecting shaft 303 can rotate at any convenient speed. Low speed shaft 304 drives clutch 305. Mounted at the other end (or side) of the bed (not shown) is a second gear box 306 driven by the interconnecting shaft 303 and with a slow speed output shaft 307 driving a clutch 308. Either roller may be driven by engaging the proper clutch with the other clutch disengaged. When engaged, clutch 305 drives keyed shaft 309. The clutch 308, when engaged, drives keyed shaft 310 at the far side (or end) of the bed. Shafts 309 and 310 are keyed to drive sheet rollers as shown on FIG. 24, mounted on either side (or end) of the bed.

As the rollers must be driven in opposite directions to function in this invention, the motor 301 may be bidirectional and the gear boxes 302 and 306 similar as to input and output rotational directions, or the motor 301 may only rotate in one direction and the gear boxes 302 and 306 may be constructed to have opposing rotational directions for a common input.

Interconnecting shaft 303 connecting the gear boxes 302 and 306 may be solid if the single motor system 311 shown is mounted to a rigid frame member, as in FIGS. 11 and 13 or, the shaft 303 may have to be flexible if the single motor system 311 is mounted as in FIGS. 12 and 14 to the movable portions of the bed frame.

In some configurations the clutches 308 and 305 shown in FIG. 38 can be removed, in which case 310 and 309 may be deleted and shafts 307 and 304 would directly drive the rollers. In this case it is necessary to allow for slack in the sheet between the roller from which the sheet is being unwound and the mattress. This slack will occur because the larger effective diameter of a full roller causes more sheet to be unwound per turn than is taken up on the opposite empty roller.

FIG. 39 shows a sideview of a roller 40 which is positioned under the bed and which is being driven in a direction to unroll sheet 9, which has slack between the roller and the mattress, as shown. With such slack, it is feasible to eliminate clutches in the roller drive mechanisms. Provisions for handling and storing the sheet (e.g., holding it in a tray or winding it up) often will not be needed, but can be included where needed.

It is clear that separate reversible motor drives without clutches can also be used for the rollers in FIG. 39, on the condition that enough additional sheet slack is used to avoid problems due to a difference in motor speeds.

FIG. 40 shows a side view of an end of a bed in which the directed edge guidance blocks 272 is mounted behind bracket 271. The blocks contain the thickened hems of the flexible sheet material such that the sheet material is taut between them. FIG. 40 shows a roller assembly 40 mounted beneath the bed frame.

When a person's body passes over the taut region of the flexible sheet material at the end of the bed, some of pressure due to the patient's weight is absorbed by the taut flexible sheet and the remainder is absorbed by the mattress 26 resting on the moveable (or fixed) bedframe. This causes a degree of sag in the mattress 26. In this configuration, the patient does not feel any substantial discomfort as the patient's body moves over the end of the bed since the roller is mounted to the frame beneath the mattress.

FIG. 40 also shows an optional wedge member 270 whose length and thickness dimensions may be changed as desired. The wedge member, also shown in FIG. 40*a*, is inserted (or can be mounted to the movable bed frame member) at and under the bottom edge of the mattress. This wedge acts to compress the mattress against the taut flexible sheet which is also shown in FIG. 30*e*. This acts to minimuize the amount of sag of the mattress 26 and flexible sheet material as the patient's body moves over the end (or side in the case of the lateral bed) of the bed.

FIG. 41 represents a generalized block diagram showing the relationship between the various function switches, the control circuitry and the motors and, when used, their associated clutches.

FIG. 41 shows an electrical power source 376 which can be either an AC and/or DC voltage source to provide the electrical power to operate the control circuitry and to drive (in a longitudinal bed configuration as shown in FIG. 20) the motors 186 and 184 and, when used, their associated clutches 187 and 185 of the first bed 2 and motors 182 and 180 and their associated clutches 183 and 181 of the second bed 3.

Automatic person transfer from the first bed 2 to the second bed 3 in a longitudinal bed configuration can be achieved by energizing the reversible "feet" motors 184 and 180 and their associated clutches 185 and 181 so that the "feet" rollers 12 and 14 of the first bed 2 and the second bed 3, respectively, will rotate in a clockwise direction (i.e., relative to the view of FIG. 1) and by simultaneously de-energizing clutches 187 and 183 which release rollers 11 and 13. This will cause the sheets of both beds to move simultaneously in a direction such that a person lying on the first bed will be transferred from the first bed to the second bed. The final resting position on the second bed will be determined by the period of time that the rollers are rotating which is adjusted by the appropriate setting of the time delay of "Adjustable Time Delay Circuit" 283.

In a similar manner, the reverse process of transferring a person from the second bed back to the first bed can be achieved by the energizing "head" motors 186 and 182 and their respective clutches 187 nd 183 so that rollers 11 and 13 rotate in a counter-clockwise direction thereby pulling the sheets of both beds in the same direction so as to return the person to essentially his original position on the first bed 2.

In the block diagram of FIG. 41, the "Start" switch 371 which is a momentary type switch turns on a bistable multivibrator or backs up a relay or starts some other memory circuit within the control circuitry 377 which, in turn, applies an appropriate voltage to the "Adjustable Time Delay" circuit 389 which begins its timing period. After the pre-set time period has elapsed, an output signal is produced from the "Adjustable Time Delay" circuit 389 which causes the memory circuit or multivibrator or relay to reset which, in turn, removes the applied voltage to the "Adjustable Time Delay" circuit 389 and causes it to reset. The automatic transfer operation from the first bed to the second is achieved by placing the "Reverse-Off-Forward" switch 370 in the "Forward" position. The "control circuitry" 377 responds to this input switch position whenever there is an applied voltage to the "Adjustable Time Delay" circuit 389 by applying the appropriate polarity drive voltage derived from the electrical power source 376 to the "feet" motors and clutches of the first and second beds as described earlier.

When the "Reverse-Off-Forward" switch is placed in the "Reverse" position and the voltage is being applied to the Adjustable Time Delay circuit 389, the applied voltage is applied to the appropriate "Head" motors and clutches as described earlier. When the "Reverse-Off-Forward " switch 370 is in the "OFF" position, automatic operation, as described, is prevented.

The bed transfer operation as well as the operation which may be required to provide slack for mechanical articulation of hospital beds or to raise a person toward the top of a hospital type bed, can also be accomplished by manually selecting the appropriate bed sheet motion operations. For example, in the situation whereby a person is in a hospital type bed in which the back of the bed is raised and in which the patient slides down toward the feet end of the bed, it is desirable to rotate only the head roller of a bed so as to "pull" the sheet toward the head end of the bed and thereby raise the patient back to his original or a normal position and to afterward lock the clutch so as to prevent any sheet motion. This is possible in the longitudinal bed configuration.

In addition to the use of the bed transfer or bed changing function of the invention with a hospital bed, it may be necessary to allow sheet material to slacken at the end in the case of the longitudinal bed arrangement, or at the sides in the case of the lateral bed arrangement, to permit bed mechanical articulation during its normal non-tansfer use. Further, it may, at times, be necessary to tighten the bed sheets to remove the rumpled or bunched up regions.

The above functions are achieved with the Manual Control switches by placing the "Normal-Off-Roller Control" switch 372 in the Roller Control position. The Control Circuitry 377 would then accept the commands from the "Roller Selection" switch 374 and the "Roller Control Pull-Lock-Slacken" switch 375. When the "Roller Control" switch 375 is in the "Lock" position, all power is removed from all motors and all four clutches are energized thereby mechanically coupling their associated rollers to their associated motors.

In the event of operation without clutches and with an appropriate amount of slack in the sheet, then the "Lock" position would merely remove all power from all four motors.

The "Roller Selection" function switch 374 is used to select which roller (i.e., head or feet roller) of which bed (i.e., first or second bed in the event a second bed is used) is to be actuated. If the "Roller Control" switch 375 is in the "Pull" position, the "Control Circuitry" 377 will cause the roller selected by switch 375 to rotate in such a direction as to pull the bedsheet material on to the roller, thereby either moving the patient in the direction of that roller or removing any undesired slack in the bed sheet. In the event the "Roller Control" switch 375 is in the "Slacken" position, the roller selected by "Roller Selection" switch 374 will rotate in such a direction as to continuously slacken the bedsheet material. In this manner, it would permit the hospital bed to mechanically articulate as described earlier.

In the case where the patient slides down the bed when the back is raised and it is desirable to raise the patient back up to a normal position, the patient or attendant would place "Roller Selection" switch 374 to select the appropriate head roller and would place the "Roller Control" switch 375 in the "Pull" position which would then pull the patient toward the head end of the bed. When the patient is positioned in the proper position, the "Roller Control" switch 375 would then be placed in the "Lock" position which would then remove all power from all motors and engage all clutches (if clutches are used) and thereby prevent any further motion of the bedsheet.

In the use of the bedsheet changing or bed transfer functions of the invention arrangement, a sheet can be put in motion across a bed releasing the clutch at one end of a bed and engaging the rollers at the opposite end. In the block diagram of FIG. 41, these functions are aciieved by placing the "Normal-Off-Roller Control" switch 372 in the "Normal" position. The control circuitry then will accept commands from the multiple position "Bed Selection (Normal) Forward-Off Reverse" switch 373 which indicates which bed or beds are to be activated and in which direction (i.e., forward or reverse) the sheet motion should move. This enables an attendant (or the patient) to move the patient to the end of the first bed and then "turn on" the bedsheet motion on the second bed until the patient is properly positioned, at which time switch 372 is placed in the "off" position. To return the patient to the first bed, the same procedure is followed except that switch 373 is placed in the "Reverse" position.

The following descriptions of the circuitry of FIGS. 42 and 43 are of specific forms of circuitry which provide the basic functions described for the generalized block diagram of FIG. 41.

In the bed transfer or bedsheet changing configurations which employ clutches, the operation of the motors and their associated clutches in either the longitudinal transfer or in the lateral transfer arrangement may be achieved by actuating individual switches connected to the motors and clutches in a sequence of stages of operation. This may be obtained by means of the circuitry shown in FIG. 42. In this circuit and for the longitudinal configuration, each of the motors 186, 184, 182, and 180 are connected in parallel with an associated clutch 187, 185, 183, and 181 whenever 7-pole triple throw switch 242 is in either the upper or lower position (i.e., in the "Slacken" or "Pull" position). As shown in the longitudinal bed transfer arrangement of FIG. 20, motor 186 and its associated clutch 187 is connected to roller 11 at the head end of bed 2; motor 184 and its associated clutch 185 is connected to roller 12 at the feet end of bed 2; motor 182 and its associated clutch 183 is connected to roller 13 at the head end of bed 3 and motor 180 and its associated clutch 181 is connected to roller 14 at the feet end of bed 3. In the schematics of FIG. 42 and FIG. 43, a DC power supply 240, which is powered through a conventional AC input plug 101, is used as the electrical power source for all circuits and to drive the various motors and energize their associated clutches. This has been done to facilitate the description of the various motor direction reversals. Directly analogous circuitry could have easily been devised using an AC power supply source, reversible AC motors and AC clutches by those skilled in the art.

In the schematic FIG. 42, when the polarity of the DC voltage applied to the motors matches that indicated on the motor, the motor rotates in a clockwise direction relative to the drawing perspective shown in FIGS. 1, 6, 19, and 20. The motors are such that an applied voltage of opposite polarity produces a counterclockwise rotation. The clutch associated with each of the motors is of a design which is not sensitive to the applied voltage polarity and when actuated, mechanically couples its associated motor output to its respective roller.

Female connector 216, which may be at the end of a cable from control box 215, is connected to male connector 217 which provides the electrical connections to the first bed 2, and thereby to motors 186 and 184 and their respective clutches 187 and 185 and also to connector 197.

When the second bed 3 is mechanically coupled to the first bed via the latching mechanisms 5 and 7 of FIGS. 1, 6, 19, and 20, a male electrical connector 198 can be constructed such that it is simultaneously aligned and inserted into its mating female connector 197. This provides the electrical connections to the motors 182 and 180 and their respective clutches 183 and 181 of the second bed 3. These electrical connectors from the control box to the motors and clutches of the second bed 3 may also be made directly via a cable connection which brings female connector 199 from control box 215 to the male connector 198.

In the circuitry of FIG. 42, there is a double pole double throw switch 241, a seven-pole double throw switch 242, a single pole relay 359, an 8-position rotary switch 244 and a four-position rotary switch 243. Switches 241 and 244 are shown in their respective OFF positions and switch 242 is shown in its "Lock" position. The positive lead 233 and the negative lead 234 of DC power supply 240 are connected to armatures 227 and 230 respectively, of switch 241.

Except as described below, when switch 241 is in the "Normal" position, switch 242 and switch 243 are inoperative and the positive voltage lead 233 is connected through switch 241 to the armature 250 of rotary switch 244. The negative lead 234 is connected to a common bus 190 thru contact 359 of switch 242 which must be in the "Slacken" or "Pull" position for the "Normal" role of switch 241 to be operative. With switch 242 in either the "Slacken" or "Pull" position, the negative lead 234 is connected via bus 190 to clutches 187, 185, 183 and 181 and to the positive terminal of motors 186 and 182 and to the negative terminal of motors 184 and 180.

The armature 250 of switch 244 is always connected to two adjacent terminals, one of which is the terminal to which the armature is directly connected, and the other is through an armature bridge connection to the terminal immediately to the left of the armature as shown in the schematic FIG. 42.

When the armature 250 is in the first position, also referred to in schematic as "1st Bed Fwd", the positive voltage lead from switch 241 is connected to terminals 200 and 201, which, with switch 242 in the "Slacken" or "Pull" position energizes motor 184 in a clockwise direction and energizes clutch 185, which in turn rotates roller 12 in a clockwise direction pulling the bedsheet and the patient toward the feet end of the first bed 2.

When the patient's body is such that the soles of the patient's feet are approximately over the junction between the first and second bed, then the attendant or the patient can turn rotary switch 244 to the second position 202, which, additionally, actuates motor 180 and clutch 181 so that the bed sheet on the second bed 3, as well as the bedsheet on the first bed 2, move in a direction so as to transport the patient onto the second bed 3. When the patient has been transported so that the patient's head is entirely on the second bed 3, the attendant or patient rotates switch 244 to the third position 203, which leaves only motor 180 and clutch 181 energized and continues to move the patient toward the feet end of the second bed 3. When the patient has been transported to the proper position on the second bed 3, the attendant or patient rotates switch 244 to the fourth position 204, which removes power from all motors and clutches and the patient ceases to move any further.

If the patient is to be returned to the first bed, then the attendant or patient rotates switches 244 to the fifth position 205, which applies a voltage to energize clutch 183 and energize motor 182 in a counter-clockwise direction so as to pull the bedsheet of the second bed 3, and thereby transport the patient toward the first bed 2. When the patient's head is close to the head end of the second bed 3, the attendant or patient then rotates switch 244 to the sixth position 206 which, in addition to continuing to energize motor 182, also energizes clutch 187 and motor 186 in a counter-clockwise direction so as to continue moving both bedsheets, and thereby the patient from the second bed 3 onto the first bed 2. When the patient's feet pass over the junction of both beds, then the patient or attendant rotates switch 244 to the seventh position 207 which removes power from the second bed 3, but continues transporting the patient toward the head end of the first bed 2. When the patient arrives at the proper location on the first bed, the attendant or patient then rotates switch 244 to the eighth or "Off" position which removes all voltage or power from all of the motors and clutches.

Any specific function (i.e., control of bedsheet motion) heretofore described and associated with either bed singly or both beds together can be placed in operation without the necessity of going through prior or sequential steps or other prior bedsheet functions by placing switch 241 in the "Off" position, and then rotating switch 244 to the desired function, and then placing switch 241 in the normal position for the desired period of time.

The above description of the control circuit schematic applies in an identical manner to a lateral transfer bed arrangement except that the motion of the bedsheet, and therefore the patient, is relative to the left and/or right sides of bed 3 and/or bed 2 of FIG. 6, and FIG. 19.

If either or both the first bed 2 or the second bed 3 is capable of mechanical articulation and it is a lateral transfer type bed as shown in FIGS. 13 and 14 or FIG. 21, or if either or both the first bed 2 or the second bed 3 is capable of mechanical articulation and it is a longitudinal transfer type bed as shown in FIG. 11 and the motor/clutch/roller assemblies 108 thereon are mounted to the non-movable base frame of the bed as shown in FIG. 11, then additional bedsheet length must be furnished from their respective rollers 11, 12, 13, 14 in the case of the longitudinal bed of FIG. 1 and respective rollers 22, 23, 24, 25 of FIG. 6 in order to provide sufficient slack to allow the mechanical articulation of the bed frame/mattress members 17, 55 and 56 without mechanical limitation from the bedsheet.

When switch 241 is in the lower or "Roller Control" position, the positive and negative terminals of the DC power supply 240 are respectively connected through switch 241 to terminals 224 and 221 of switch 242.

When switch 242 is in the upper or "Slacken" position, a positive polarity voltage is applied to the common bus 190 and therefore to one side of each of the motors and clutches of both beds (if two are used) and the negative polarity voltage is applied to the armature 214 of the four position rotary switch 243. Switch 243 has its four position terminals 210, 211, 212, and 213 each connected respectively to motors 180, 182, 186 and 184. The respective clutches 181, 183, 187 and 185 of motors 180, 182, 186 and 184 are connected to the four position terminals 210, 211, 212 and 213, respectively, of switch 243 thru contacts 363, 362, 360 and 361, respectively of switch 242 when switch 242 is in either the "Slacken" or "Pull" position.

With switch 242 in the "Slacken" position, the motors controlling the motion of the head or feet rollers of either bed 3 or bed 2 can only rotate in a direction as to produce a slackening of the bedsheet, thereby permitting a hospital type bed to be mechanically articulated.

When a particular roller has rotated sufficiently to provide the necessary slack, then the operator or patient will place switch 242 in the "Lock" position and all motors will stop rotating and in addition all of the clutches will be energized thereby coupling the rollers to their respective motors and thereby preventing any sheet motion.

In the event the operator determines that too much or an excess of slack has been provided, then by placing switch 242 in the "Pull" position, the respective voltages to the common bus 190 and to the armature 214 of switch 243 will reverse polarity and the motors controlling the rotation of the rollers will and can only rotate in a direction so as to tighten the bedsheet or reduce the slack. When the appropriate amount of slack has been determined, the attendant places switch 242 in the "Lock" position. When switch 242 is in the center or "Lock" position, all applied voltage is removed from all motors; however, all clutches are energized as the positive voltage at terminal 224 is applied thru contacts 363, 362, 361 and 360 of switch 242 to clutches 181, 183, 185 and 187. The negative voltage is applied thru contact 221 to the common bus 190. In the "Lock" position of switch 242, all rollers are mechanically coupled to their respective motors, and therefore, since each motor would have a speed reduction gear assembly associated with its output drive shaft, each roller would be locked or unable to rotate.

When a patient is in a hospital bed and the back of the bed is raised and the patient has slid down to an uncomfortable position and wishes to be raised to a normal position, the attendant or patient may place switch 243 in the "1st" or "2nd Head Roller" position as the case may be, and place switch 242 in the "PULL" position until person is raised to the desired position and then place the switch in the "Lock" position thereby preventing the bedsheet from further motion.

When a bed sheet on any type of bed is excessively rumpled or bunched, the bedsheet can be tightened by the attendant or patient placing switch 243 in the "1st Head Roller" position, and place switch 242 in the "Pull" position until the patient moves toward the head of the bed for about a foot or so. Then switch 242 is placed in the "Lock" position, and then switch 242 is placed in the "1st bed Feet Roller" position. Then switch 242 should be placed in the "Pull" position until the patient is returned to his original starting position. The alternate pulling toward the head end and then toward the feet end of the bed will striaghten the sheet.

The identical analogous slack control function applies to the lateral transfer bed so that the motor determining the rotational direction of rollers 22, 23, 24 and 25 of FIG. 6, 13, 14, or 19 can be made to rotate clockwise or counter-clockwise to adjust the bedsheet slack on the right and left sides of the bed so as to enable the beds to mechanically articulate.

It is clear to those skilled in the art that a similar control system can be employed using AC motors. For example, in FIG. 41, polarized triple-pole triple-throw relays and AC motors which are connected through those relays to an AC power line could be substituted for the DC motors which are shown. Such relays, which normally employ permanent magnet armatures, can perform the functions of a conventional forward-/off/reverse switch for an AC two-phase induction motor or single-phase capacitor motor, for example. With a positive DC control voltage on the positive reference terminal, the relay will switch in one direction to cause the motor to drive in the forward direction. With the polarity reversed, the relay will switch in the other direction to cause the motor to drive in the reverse direction. With zero control voltage, the relay will remain in its center position in which the motor is disconnected from the power source. Additional wires and connector contacts must be added to both beds to connect the AC power to input terminals on the polarized relays.

FIG. 43 shows a specific circuit schematic diagram which enables the automatic transfer of a patient from the first bed 2 to the second bed 3 or apparatus 3, and the automatic transfer of a patient from the second bed 3 or apparatus 3 to the first bed 2.

This is basically accomplished by simultaneously energizing motor driven rollers on corresponding ends or sides of two adjacent beds or one bed and one adjacent apparatus, such that the rollers pull the respective flexible sheet material or bed sheets of the beds, and/or of one bed and the flexible sheet material of an apparatus, at the approximate same speed and in the same direction, that is, lengthwise (i.e., toward the head or feet end) in the case of longitudinal transfer arrangement or sideways (i.e., toward the left or right side) in the case of the lateral transfer arrangement. The person lying on one bed will be carried thereby from one bed onto the other bed or onto a similarly equipped apparatus 3.

The final resting position of the person on the second bed or apparatus will, therefore, be determined by the period of time that these motors are engergized. The period of time is determined by the setting of the "Adjustable Delay Timer" 283 used in the circuit diagram of FIG. 43.

In a similar manner, the reverse transfer from the second bed or apparatus to the first bed is accomplished by applying an opposite polarity voltage for an identical period of time to the corresponding opposite side or opposite end pair of motor-driven rollers. This will reverse the transporting piano roll or conveyor type motion of the bed sheet or flexible sheet material for the same period of time that was initially required to go forward (i.e., from the initial position on bed 2 to the corresponding position on bed 3 or apparatus 3) and therefore will transport the patient back to essentially the same position on bed 2 that the patient was at initially.

In the schematic diagram of FIG. 43, all of the motors 186, 184, 182, and 180 and their respective associated clutches 187, 185, 183, and 181 as well as their respective associated rollers 11, 12, 13, and 14 for the longitudinal transfer bed or their respective rollers 22, 23, 24, and 25 for the lateral transfer bed, have directional rotations as described for FIG. 42. The clutches in FIG. 43 are all connected in parallel with their respective motors and are actuated when an appropriate applied voltage of any polarity is applied to its terminals. The electrical connections from control box 220 are made through connectors 218, 219, 217, 197 and 198 in a similar manner as described for FIG. 42.

To transfer the patient from bed 2 to bed 3, the attendant or patient first places the "Reverse-Off-Forward" switch 239 in the "Forward" position which enables the positive DC voltage at terminal 233 of the power supply 240 to be connected through switch armature 287 to terminal 290 of switch 239, which in turn is connected to the armature terminal 258 of four pole relay 235 (shown de-energized). When relay 235 is energized, the positive DC voltage is then connected to terminal 262 and, therefore, applied to motor 180, associated clutch 181, and to motor 184, and associated clutch 185. This causes their respective rollers to rotate in a direction which pulls the bed sheets of both beds in the same direction so as to move the patient from the first bed 2 to the second bed 3. Since switch 239 is in the "Forward" position, there is no voltage applied to motor 186, clutch 187, motor 182, and clutch 183. Therefore their respective rollers 11 and 13 for the longitudinal transfer arrangement and rollers 22 and 24 for the lateral transfer arrangement are mechanically free to rotate and thereby release the bed sheet or flexible sheet material.

The position that the patient will be at on bed 3 or on apparatus 3 is determined by the period of time that relay 235 is energized. This period of time is determined by the setting of the "Adjustable Delay Timer" 283 which actuates relay 236 (shown de-energized) at the end of the "delay time" setting which (in turn as described later) causes relay 235 to be de-energized.

When switch 239 is in the "Off" position, all motors and clutches are de-energized.

When the patient or attendant momentarily actuates "Momentary Start" switch 238, the coil 266 of four pole relay 235 is momentarily energized by the positive voltage at terminal 233 of DC power supply 240 by being applied through terminals 291 and 293 of switch 238 to terminal 265 of relay 235. This causes the positive voltage at terminal 233 of the DC power supply 240 to be applied through contacts 282 and 274 of relay 276 (since relay 236 is normally in the de-energized state until the preset time delay has elapsed), through contacts 259 to 263 to 264 to 260 of relay 235 and to terminal 265 of relay coil 266 which maintains relay 235 in the energized state. The negative terminal 234 of DC power supply 240 is connected to terminals 267 and 268 of relays 235 and 236, respectively, as well as to terminal 285 of adjustable delay timer 283 and to common bus 190 which is connected to all motors and clutches.

With relay 235 energized, the positive voltage at terminal 264 and 263 is also applied to terminal 284 of adjustable delay timer 283. When the positive voltage has been applied to timer 283 for a period of time equal to the time interval that had been manually preset, then the output of timer 283 is a positive voltage at terminal 296 which is applied to terminal 275 of relay coil 276 of relay 236. This, therefore, actuates relay 236 which causes its relay armature 274 to disconnect from contact 282 and connect to open contact 281, which in turn removes the positive voltage applied through the contacts of relay 235 to relay coil 266, thereby de-energizing relay 235, which opens all of the contact closures of relay 235. This action removes the positive voltage from timer 283 and thereby resets it to zero time elapsed and also removes the positive voltage from any of the motors or clutches by opening the relay contact 257 to 261 and relay contact closure 258 to 262.

If the "Forward-Off-Reverse" switch 239 is placed in the "Reverse" position, the positive voltage of terminal 233 is then connected through armature 287 to terminal 288, of switch 239, to terminal 257 of relay 235 which is shown de-energized. When relay 235 is energized as described earlier, the positive voltage is then connected to terminal 261 of relay 235 and, therefore, applied to the negative terminal of motor 186 and its associated clutch 187, and to the negative terminal of motor 182 and its associated clutch 183. This produces a counterclockwise or opposite rotation of their respective rollers for the period of time preset in the "Adjustable Delay Timer" 283, thereby pulling the sheets of both beds so as to move the patient from bed 3 to bed 2.

I claim:

1. A person transfer arrangement comprising: a first support having a flexible sheet of material extending across a flat surface on which a person may lie; means for pulling said flexible sheet with said person to and beyond an edge of said first support; means for positioning a second support at an edge of said first support; means for controlling motion of said flexible sheet on said first support for transporting a person from one said support to the other; one of said supports comprising a bed; said pulling means comprising further roller means at opposite edges of the bed, and means for driving said roller means so that said flexible sheet is wound on either of said roller means and unwound on the other roller means; alignment means for spreading the sheet independent of counteracting forces and stresses and for guiding said sheet in motion between said roller means; said alignment means comprising means for thickening edges of said sheet, and alignment wheels for passing said sheet between said alignment wheels with said edges on the outside of said wheels.

2. A person transfer arrangement as defined in claim 1, wherein said alignment means comprise means for thickening edges of said sheet, and edge guidance members containing shaped grooves having narrow outer slits through which the sheet passes and wider inner grooves through which the thickened edges of the sheet pass.

3. A person transfer arrangement as defined in claim 1, wherein said sheet has thickened edges suitable for being drawn across a bed by being wound on a roller so as to transport a person lying on said sheet to and beyond the edge of the bed; said thickened edges in conjunciton with said alignment means providing means for aligning said sheet with said roller.

4. A person transfer arrangement comprising: a bed with a mattress and a flexible sheet of material across the mattress on which a person may lie; rollers at opposite edges of the bed; driving means for winding said sheet on either of said rollers and unwinding it from the other roller; said rollers pulling the person to and beyond an edge of said mattress and onto a contiguous support having a top surface; means for controlling said driving means to transport the person between the bed and the support; said bed including alignment means for spreading the sheet independent of counteracting forces and stresses and for guiding said sheet in motion between said rollers; said alignment means comprising thickened edges on said sheet; and alignment wheels for passing the sheet between the alignment wheels and said edges on the outside of said wheels.

5. A transfer bed arrangement as defined in claim 4 wherein said driving means comprises separate motor means for each roller.

6. A transfer bed arrangement as defined in claim 4, wherein said driving means comprises a single reversible motor and speed reduction means connected to each said roller means.

7. A transfer bed arrangement as defined in claim 4, wherein said driving means includes means for leaving slack in said flexible sheet.

8. A transfer bed arrangement as defined in claim 4, wherein said driving means includes motor means with speed reduction means and clutch means for connecting to either one of said rollers; and manually-actuated switch means for controlling said motor means and clutch means.

9. A transfer bed arrangement as defined in claim 4, wherein said rollers are located beneath the bed, said flexible sheet sliding over the top and edges of the bed to said rollers.

10. A transfer bed arrangement as defined in claim 4, including idler roller means at said edges of the bed to reduce frictional effects and guide said sheet between said rollers.

11. A transfer bed arrangement as defined in claim 4, wherein said sheet has thickened edges adapted for being drawn across a bed by being wound on a roller so as to transport a person lying on said sheet to and beyond the edge of the bed; said thickened edges in conjunction with said alignment wheels comprising means for aligning said sheet with said roller.

12. A person transfer arrangement comprising: a bed with a mattress having a flexible sheet of material across the mattress on which a person may lie; roller means located at opposite edges of said bed; said sheet being moved across said mattress through contact with said roller means; a contiguous support having a top surface in vicinity of said bed; driving means acting on said roller means for pulling said person to and beyond an edge of said mattress and onto said support; means for controlling motion of said sheet to transport the person between the bed and the support; said bed including alignment means for spreading the sheet independent of counteracting forces and stresses and for guiding said sheet in motion between said roller means; said alignment means comprising thickened edges on said sheet, and alignment wheels for passing the sheet between the alignment wheels with said edges on the outside of said wheels.

13. A person transfer arrangement as defined in claim 12, including a flexible sheet on said support; and means for controlling motion of the flexible sheets on said bed and said support for transporting a person between the bed and the support.

14. A transfer bed arrangement as defined in claim 12, wherein said roller means comprises rollers at opposite edges of the bed; and means for driving the rollers so that said flexible sheet is wound on either of said rollers and unwound from the other roller.

15. A person transfer arrangement comprising: a bed with a mattress and a flexible sheet of material across the mattress on which a person may lie; rollers at opposite edges of the bed; driving means for winding said sheet on either of said rollers and unwinding it from the other roller; said rollers pulling the person to and beyond an edge of said mattress and onto a contiguous support having a top surface; means for controlling said driving means to transport the person between the bed and the support; said bed including alignment means for spreading the sheet independent of counteracting forces and stesses and for guiding said sheet in motion between sad rollers; said alignment means comprising thickened edges on said sheet, and alignment wheels; said sheet passing between the alignment wheels with said thickened edges on the outside of said wheels.

* * * * *